US010777974B2

(12) United States Patent
Nishio et al.

(10) Patent No.: US 10,777,974 B2
(45) Date of Patent: Sep. 15, 2020

(54) SPARK PLUG FOR INTERNAL COMBUSTION ENGINE THAT MAKES RE-DISCHARGE LESS PRONE TO OCCUR

(71) Applicant: DENSO CORPORATION, Kariya, Aichi-pref. (JP)

(72) Inventors: Noriaki Nishio, Kariya (JP); Masamichi Shibata, Kariya (JP); Kanechiyo Terada, Kariya (JP); Ken Hanashi, Kariya (JP); Ryohei Akiyoshi, Kariya (JP); Fumiaki Aoki, Nisshin (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/551,912

(22) Filed: Aug. 27, 2019

(65) Prior Publication Data

US 2019/0386467 A1 Dec. 19, 2019

Related U.S. Application Data

(63) Continuation of application No. PCT/JP2018/009193, filed on Mar. 9, 2018.

(30) Foreign Application Priority Data

Mar. 9, 2017 (JP) ..... 2017-044932

(51) Int. Cl.
*H01T 13/32* (2006.01)

(52) U.S. Cl.
CPC ..... *H01T 13/32* (2013.01)

(58) Field of Classification Search
CPC ..... H01T 13/14; H01T 13/32; H01T 13/467
See application file for complete search history.

(56) References Cited

U.S. PATENT DOCUMENTS 9,482,203 B2 * 11/2016 Hanashi ..... F02P 13/00
2007/0216278 A1 9/2007 Yoshida
(Continued)

FOREIGN PATENT DOCUMENTS

JP 9-129356 5/1997
JP 10-214670 8/1998
(Continued)

OTHER PUBLICATIONS

Translated international search report (Year: 2018).*

*Primary Examiner* — Tracie Y Green
(74) *Attorney, Agent, or Firm* — Nixon & Vanderhye P.C.

(57) ABSTRACT

A center electrode is held in insulating glass, in which a tip end portion of the center electrode protrudes. A ground electrode has a connection part connected to a housing. The ground electrode forms a spark discharge gap between the center electrode and the ground electrode. The ground electrode has a ground base material that includes the connection part and a ground protrusion part that protrudes from the ground base material toward the center electrode and forms the spark discharge gap between the center electrode and the ground electrode. An angle between a ground discharge surface of the ground protrusion part and a side surface of the ground protrusion part is a right angle or an acute angle. At least a portion of the side surface of the ground protrusion part and at least a portion of a side surface of the ground base material are flush with each other.

17 Claims, 22 Drawing Sheets

(56) References Cited

U.S. PATENT DOCUMENTS

| | | | |
|---|---|---|---|
| 2011/0210659 | A1 | 9/2011 | Suzuki et al. |
| 2013/0099652 | A1 | 4/2013 | Below et al. |
| 2014/0361676 | A1 | 12/2014 | Ban et al. |

FOREIGN PATENT DOCUMENTS

| | | |
|---|---|---|
| JP | 2012-134084 | 7/2012 |
| JP | 2012-150992 | 8/2012 |

* cited by examiner

SPARK PLUG FOR INTERNAL COMBUSTION ENGINE THAT MAKES RE-DISCHARGE LESS PRONE TO OCCUR

CROSS-REFERENCE TO RELATED APPLICATION

The present application is a continuation application of International Application No. PCT/JP2018/009193, filed Mar. 9, 2018, which claims priority to Japanese Patent Application No. 2017-044932, filed on Mar. 9, 2017. The entire contents of each of which are hereby incorporated by reference.

BACKGROUND

Technical Field

The present disclosure relates to a spark plug for internal combustion engine.

Background Art

A spark plug in which each of a center electrode and a ground electrode has a base material and a noble metal chip bonded to the base material and a spark discharge gap is formed between the noble metal chip of the center electrode and the noble metal chip of the ground electrode is known.

SUMMARY

A first aspect of the present disclosure is a spark plug for an internal combustion engine including: a cylindrical housing; a cylindrical insulating glass; a center electrode; and a ground electrode that forms a spark discharge gap between the center electrode and the ground electrode. The ground electrode has a ground protrusion part that forms the spark discharge gap between the center electrode and the ground electrode. An angle between a ground discharge surface and a side surface of the ground protrusion part is a right angle or an acute angle. At least a portion of the side surface of the ground protrusion part and at least a portion of a side surface of the ground base material are flush with each other.

A second aspect of the present disclosure is a spark plug for an internal combustion engine including: a cylindrical housing; cylindrical insulating glass; a center electrode; and a ground electrode that forms a spark discharge gap between the center electrode and the ground electrode. The center electrode has a center base material and a center protrusion part. An angle between a center discharge surface of the center protrusion part and a side surface of the center protrusion part is a right angle or an acute angle. At least one of angles between the plurality of side surfaces of the center protrusion part is a center specific angle that is located at an end portion of the center protrusion part opposite to the connection part side of the orthogonal direction. Surfaces forming the center specific angle among the side surfaces of the center protrusion part are flush with a side surface of a center base material.

BRIEF DESCRIPTION OF THE DRAWINGS

The foregoing and other objects, features, and advantages of the present disclosure will be more clarified by the following detailed descriptions with reference to the accompanying drawings. The drawings are as follows.

DETAILED DESCRIPTION OF THE PREFERRED EMBODIMENTS

Figure 1:
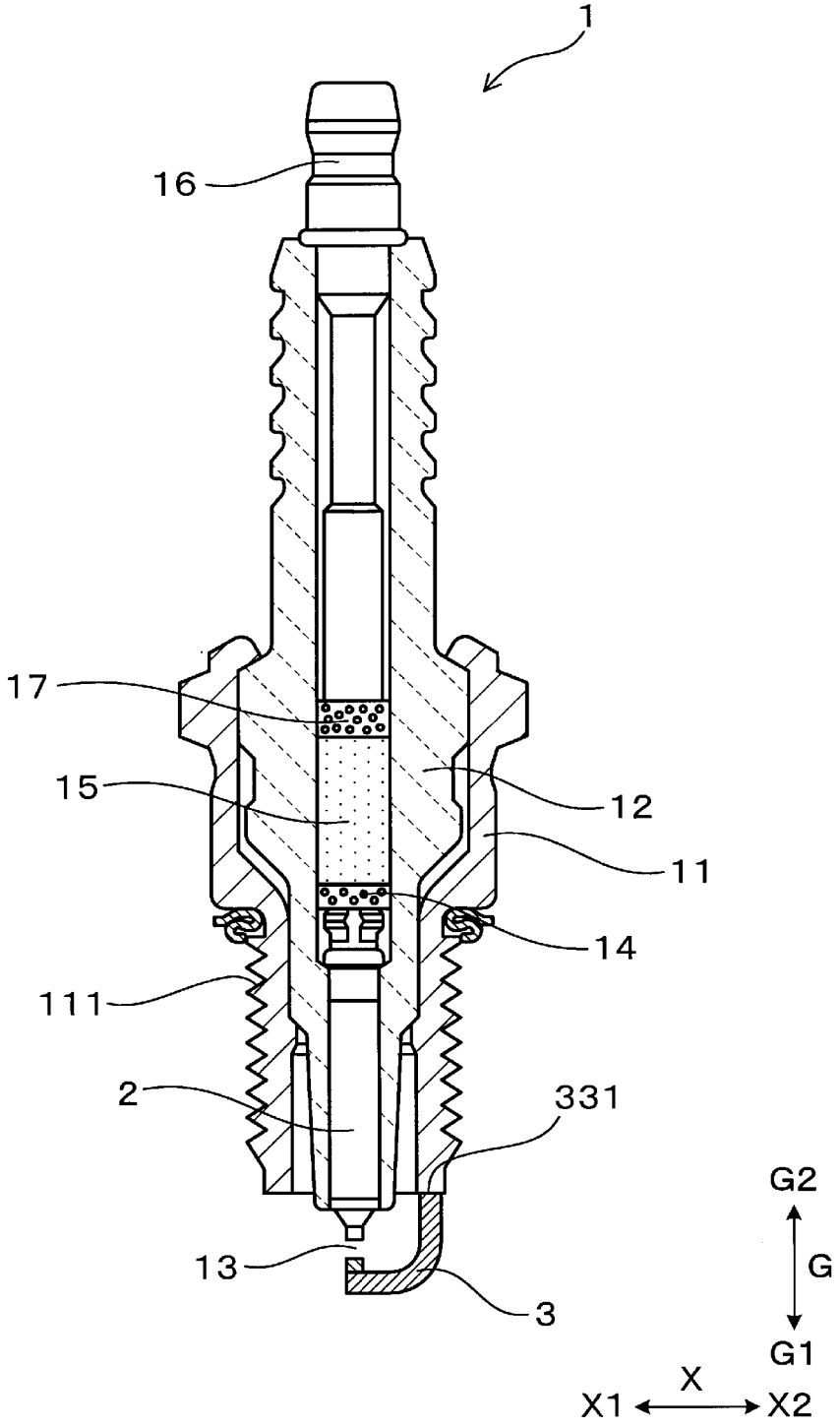
FIG. 1 is a cross-sectional view of a spark plug in a first embodiment.

A spark plug is used as an ignition means in an internal combustion engine such as an automobile engine. The spark plug is structured such that a center electrode and a ground electrode are axially opposed to each other and a spark discharge gap is formed between these electrodes. A pulse voltage is applied between the center electrode and the ground electrode to cause spark discharge in the spark discharge gap.

The inventor of the present disclosure has studied spark plugs for internal combustion engines that help improve ignitability by making re-discharge less prone to occur.

In the conventional spark plug described above, the discharge spark generated between the center electrode and the ground electrode is blown off by the air-fuel mixture, and re-discharge is prone to occur such that spark discharge is caused again between the center electrode and the ground electrode. This will be described below.

In the conventional spark plug described above, the starting point of the discharge spark generated between the center electrode and the ground electrode may move from the noble metal chip of the center electrode or the noble metal chip of the ground electrode to the base material to which the noble metal chip is bonded. When the starting point of the discharge spark moves from the noble metal chip to the base material, the axial distance between the both starting points of the discharge spark becomes longer in the axial direction. When the axial distance between the both starting points of the discharge spark becomes too long, the portion of the discharge spark between the both end portions tends to be stretched in such a manner as to excessively bulge toward the downstream side of the air-fuel mixture, whereby the discharge spark may be likely to be blown off. When the discharge spark is blown off, re-discharge takes place between the center electrode and the ground electrode in the axial direction. As above, re-discharge is likely to occur in the conventional spark plug described above.

With an increase in the frequency of occurrence of re-discharge, the position of the spark discharge may greatly fluctuate and cause variations in overheated portions of the air-fuel mixture, for example, thereby deteriorating ignitability and increase wear of the center electrode and the ground electrode.

The present disclosure is intended to provide a spark plug for internal combustion engine that helps improve ignitability by making re-discharge less prone to occur.

A first aspect of the present disclosure is a spark plug for an internal combustion engine including: a cylindrical housing; a cylindrical insulating glass held in the housing; a center electrode that is held in the insulating glass such that a tip end portion thereof protrudes; and a ground electrode that has a connection part connected to the housing and forms a spark discharge gap between the center electrode and the ground electrode. The ground electrode has a ground base material that includes the connection part and a ground protrusion part that protrudes from the ground base material toward the center electrode and forms the spark discharge gap between the center electrode and the ground electrode. An angle between a ground discharge surface of the ground protrusion part facing the spark discharge gap and a side surface of the ground protrusion part is a right angle or an acute angle. At least a portion of the side surface of the ground protrusion part and at least a portion of a side surface of the ground base material are flush with each other.

A second aspect of the present disclosure is a spark plug for an internal combustion engine including: a cylindrical housing; cylindrical insulating glass held in the housing; a center electrode that is held in the insulating glass such that a tip end portion thereof protrudes; and a ground electrode that has a connection part connected to the housing and forms a spark discharge gap between the center electrode and the ground electrode. The center electrode has a center base material and a center protrusion part that protrudes from the center base material toward the ground electrode and forms the spark discharge gap between the ground electrode and the center electrode. An angle between a center discharge surface of the center protrusion part opposed to the spark discharge gap and a side surface of the center protrusion part is a right angle or an acute angle. The center protrusion part has a plurality of the side surfaces. When, out of planar directions parallel to both an axial direction and a lateral direction orthogonal to the axial direction and in which the connection part of the ground electrode and the center electrode are aligned, a direction orthogonal to a gap direction in which the center electrode, the spark discharge gap, and the ground electrode are aligned is defined as an orthogonal direction, at least one of angles between the plurality of side surfaces of the center protrusion part is a center specific angle that is located at an end portion of the center protrusion part opposite to the connection part side of the orthogonal direction. Surfaces forming the center specific angle among the side surfaces of the center protrusion part are flush with a side surface of the center base material.

In the spark plug for internal combustion engine in the first aspect, the angle between the ground discharge surface of the ground protrusion part facing the spark discharge gap and the side surface of the ground protrusion part is a right angle or an acute angle. This makes it easy to ensure the intensity of an electric field around the angle between the ground discharge surface and the side surface of the ground protrusion part. Accordingly, it is easy to keep a ground electrode-side starting point of a discharge spark at the angle between the ground discharge surface and the side surface of the ground protrusion part, thereby suppressing movement of the ground electrode-side starting point of the discharge spark to the ground base material. This suppresses the blow-off and re-discharge of the discharge spark.

In addition, at least a portion of the side surface of the ground protrusion part and at least a portion of the side surface of the ground base material are flush with each other. Therefore, it is possible to suppress concentration of an electric field around the portion of the ground base material where the ground protrusion part is disposed. Accordingly, it is possible to suppress movement of the ground electrode-side starting point of the discharge spark from the ground protrusion part to the ground base material. This also suppresses blow-off and re-discharge of the discharge spark.

In addition, in the spark plug for internal combustion engine in the second aspect, the angle between the center discharge surface and the side surface of the center protrusion part is a right angle or an acute angle. This makes it easy to keep a center electrode-side starting point of a discharge spark at the angle between the center discharge surface and the side surface of the center protrusion part, thereby suppressing blow-off and re-discharge of the discharge spark.

At least one of the angles between the plurality of side surfaces of the center protrusion part is the center specific angle that is located at the end portion of the center protrusion part opposite to the connection part side of the orthogonal direction. That is, the center protrusion part has the angle around which an electric field tends to concentrate, formed at the end portion of the center protrusion part opposite to the connection part side of the orthogonal direction. Therefore, it is easy to keep the center electrode-side starting point of a discharge spark at the end portion of the center protrusion part opposite to the connection part side of the orthogonal direction. This makes it possible to suppress a phenomenon that the heat of a flame generated by ignition of the discharge spark to the air-fuel mixture is lost to the ground electrode (flame-out effect) caused by the discharge spark approaching the portion of the ground electrode on the connection part side of the orthogonal direction of the center protrusion part.

As described above, according to the foregoing aspects, it is possible to provide a spark plug for internal combustion engines that helps improve ignitability by making re-discharge less prone to occur.

First Embodiment

A first embodiment of a spark plug for internal combustion engine will be described with reference to FIGS. 1 to 9.

As illustrated in FIG. 1, the spark plug 1 for internal combustion engines in the present embodiment has a cylindrical housing 11, cylindrical insulating glass 12 held in the housing 11, a center electrode 2, and a ground electrode 3. The center electrode 2 is held in the insulating glass 12 such that its tip end portion protrudes. The ground electrode 3 has a connection part 331 connected to the housing 11. The ground electrode 3 forms a spark discharge gap 13 between the center electrode 2 and the ground electrode 3.

Figure 2:
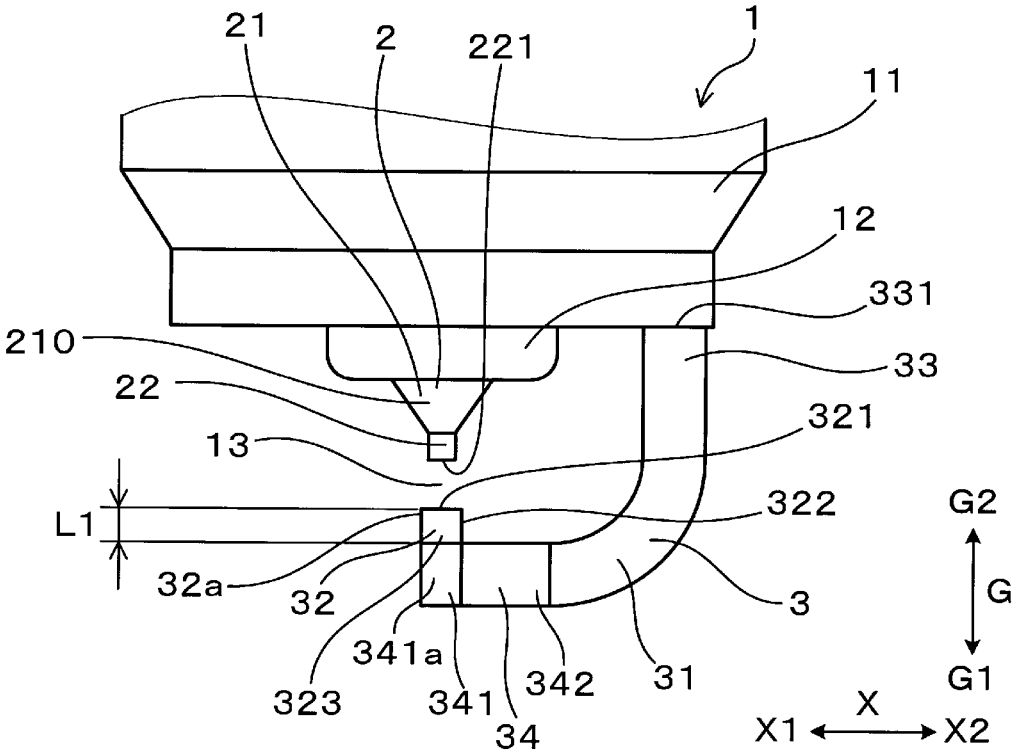
FIG. 2 is a diagram of a tip end portion and its vicinity, in the spark plug in the first embodiment as seen from a vertical direction.

As illustrated in FIG. 2, the ground electrode 3 has a ground base material 31 that includes the connection part 331 and a ground protrusion part 32 that protrudes from the ground base material 31 toward the center electrode 2 and forms the spark discharge gap 13 between the center electrode 2 and the ground electrode 3. In a gap direction G in which the center electrode 2, the spark discharge gap 13, and the ground electrode 3 are aligned, a protrusion length L1 of the ground protrusion part 32 from the ground base material 31 is 0.5 mm or more.

Figure 5:
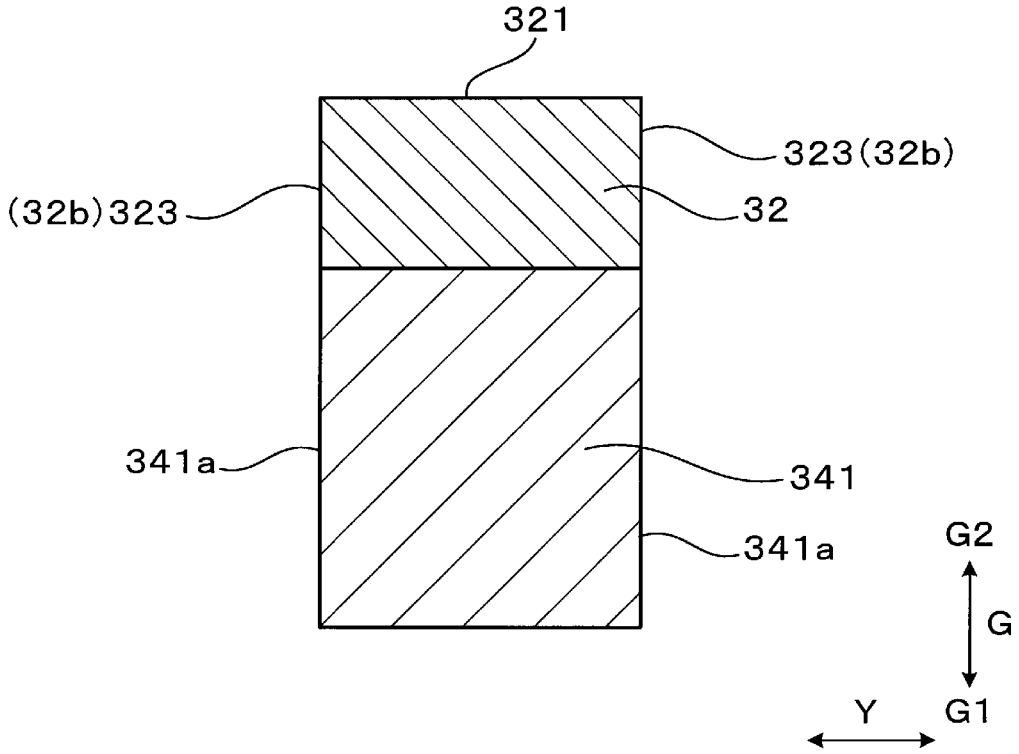
FIG. 5 is an arrow cross-sectional view of FIG. 4 taken along line V-V.

As illustrated in FIGS. 2 and 5, angles between a ground discharge surface 321 of the ground protrusion part 32 facing the spark discharge gap 13 and side surfaces 322, 323, and 324 of the ground protrusion part 32 are right angles or acute angles. In the present embodiment, all the angles between the ground discharge surface 321 and the side surfaces 322, 323, and 324 of the ground protrusion part 32 are right angles. At least part of the side surfaces 322, 323, and 324 of the ground protrusion part 32 and at least part of the side surface of the ground base material 31 are flush with each other. In other words, at least part of the side surfaces 322, 323, and 324 of the ground protrusion part 32 and at least part of the side surface of the ground base material 31 are formed to be smoothly continuous.

The spark plug 1 can be used as an ignition means in an internal combustion engine of an automobile, a cogeneration system, or the like, for example. One axial end of the spark plug 1 is connected to an ignition coil which is not illustrated and the other axial end of the spark plug 1 is disposed in the combustion chamber of the internal combustion engine.

The simple term "axial direction" here refers to a direction in which the center axis of the spark plug 1 extends unless otherwise specified.

A direction orthogonal to the axial direction and in which the connection part 331 of the ground electrode 3 and the center electrode 2 are aligned will be called lateral direction X. A center electrode 2 side of the lateral direction X with respect to the connection part 331 will be called the X1 side, and the opposite side will be called the X2 side. A direction orthogonal to both the axial direction and the lateral direction X will be called the vertical direction Y.

A ground electrode 3 side of the gap direction G with respect to the center electrode 2 will be called the G1 side, and the opposite side will be called the G2 side. As described later, in the present embodiment, the gap direction G is the axial direction.

Figure 7:
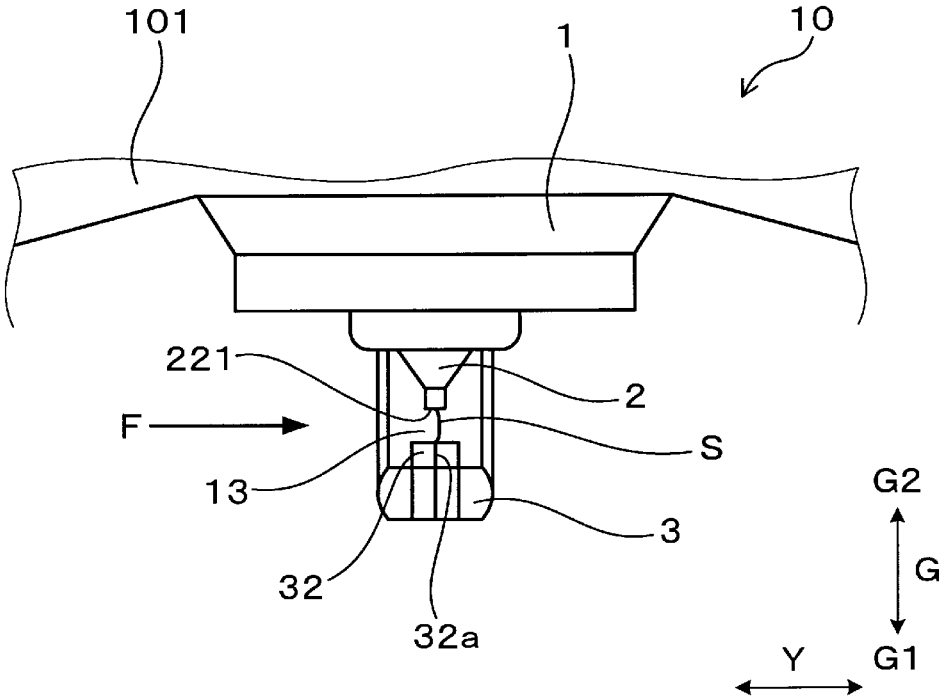
FIG. 7 is an enlarged front view of the tip end portion and its vicinity, in the spark plug in an ignition device in the first embodiment, illustrating an initial discharge spark.

As illustrated in FIG. 1, the housing 11 has an attaching screw part 111 for attaching the spark plug 1 to an engine head 101 (see FIG. 7). The insulating glass 12 is held in the housing 11 such that its tip end portion protrudes toward the G1 side of the housing 11 and its distal end portion protrudes toward the G2 side of the housing 11. The center electrode 2 is held at the internal tip end portion of the insulating glass 12.

Figure 3:
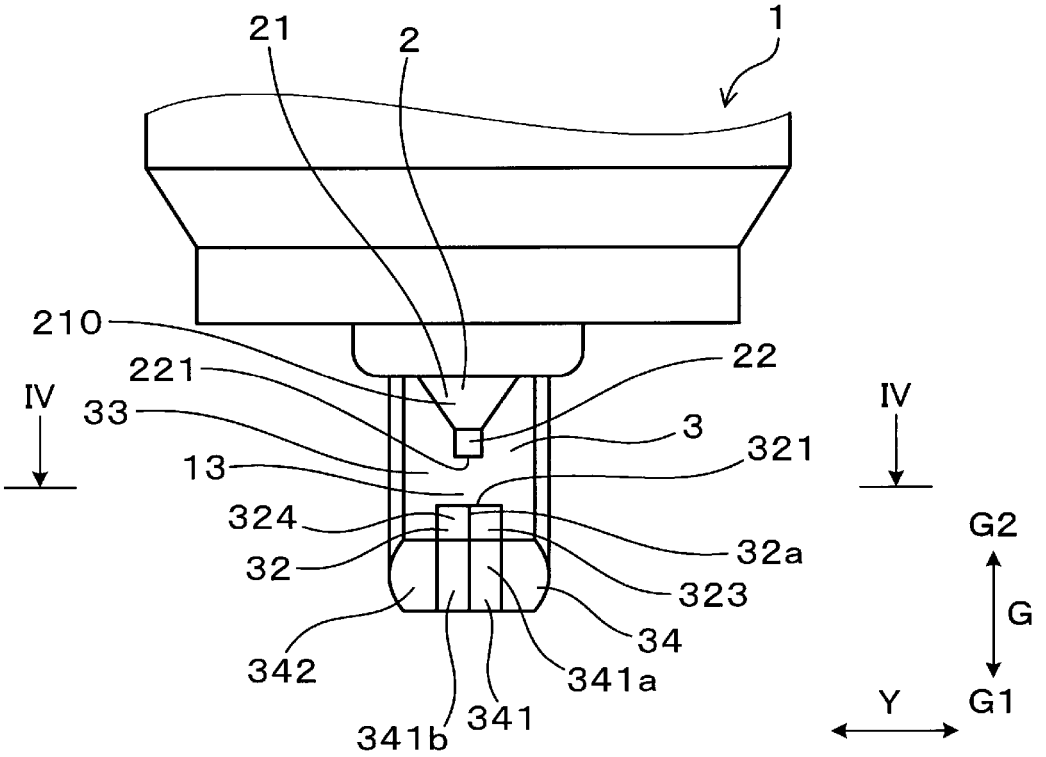
FIG. 3 is a diagram of the tip end portion and its vicinity, in the spark plug in the first embodiment as seen from a lateral direction.

The center electrode 2 has a center axis approximately aligned with the center axis of the spark plug 1. The center electrode 2 has an approximately columnar shape as a whole. As illustrated in FIGS. 2 and 3, the center electrode 2 has a center base material 21 and a center protrusion part 22 protruding from the center base material 21 toward the ground electrode 3 and forming the spark discharge gap 13 between the ground electrode 3 and the center electrode 2. In the present embodiment, the center base material 21 and the center protrusion part 22 are separate members. A base material tip end portion 210 as a tip end portion of the center base material 21 is in the shape of a truncated cone that reduces in diameter toward the G1 side. The center protrusion part 22 is bonded to the tip end surface of the base material tip end portion 210. The center protrusion part 22 has a columnar shape. The G1-side surface of the center protrusion part 22 is a center discharge surface 221 facing the spark discharge gap 13.

The ground base material 31 has an erected part 33 and an inward-facing part 34. The erected part 33 stands erect from the tip end surface of the housing 11 toward the G1 side in the gap direction G. As illustrated in FIG. 2, the erected part 33 has the connection part 331 at the G2-side end portion and is connected at the connection part 331 to the tip end surface of the housing 11. The erected part 33 has thickness in the lateral direction X.

Figure 4:
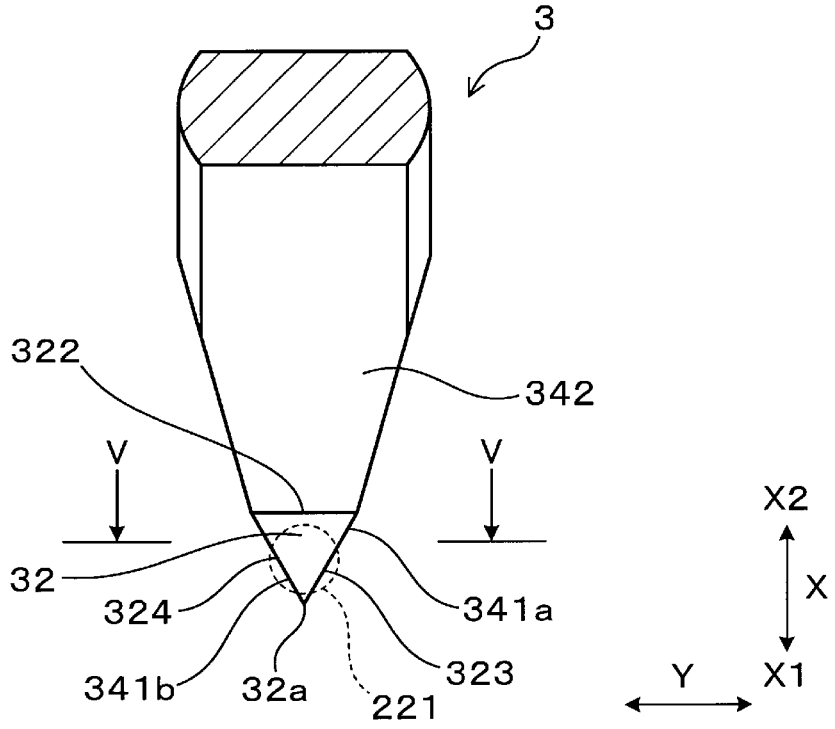
FIG. 4 is an arrow cross-sectional view of FIG. 3 taken along line IV-IV.

The inward-facing part 34 is extended from the G1-side end portion of the erected part 33 toward the X1 side of the lateral direction X. In the present embodiment, the inward-facing part 34 partially overlaps the center discharge surface 221 of the center protrusion part 22 in the gap direction G. The inward-facing part 34 has thickness in the gap direction G. In FIG. 4, the position of the outer shape of the center discharge surface 221 in the planar direction orthogonal to the gap direction G is shown by a dashed line.

Figure 6:
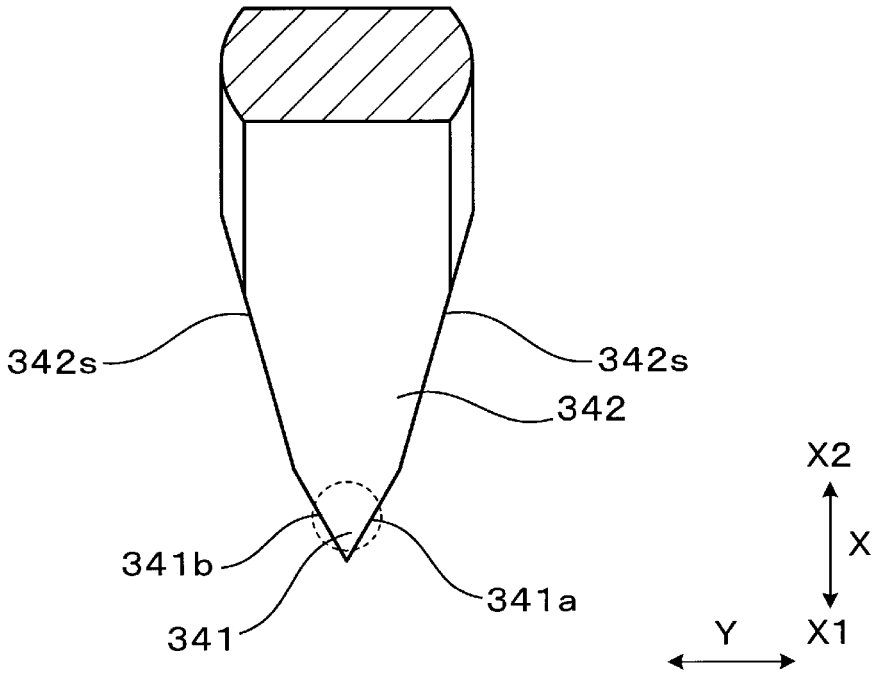
FIG. 6 is a diagram omitting a ground protrusion part from FIG. 4.

As illustrated in FIG. 2, the ground base material 31 has a ground base material end portion 341 at the end portion opposite to the connection part 331 in the longitudinal direction. As illustrated in FIG. 6, the ground base material end portion 341 has the shape of a triangular prism that becomes narrower toward the X1 side. The ground base material end portion 341 has a triangular cross section orthogonal to the gap direction G. In the present embodiment, the ground base material end portion 341 at least partially overlaps the center discharge surface 221 of the center protrusion part 22 in the gap direction G.

The inward-facing part 34 has a tapered portion 342 adjacent to the X2 side of the ground base material end portion 341. As seen from the gap direction G, the tapered portion 342 has a trapezoidal shape that becomes narrower toward the X1 side.

As illustrated in FIG. 6, each of a side surface 342*s* of the tapered portion 342 and side surfaces 341*a* and 341*b* of the ground base material end portion 341 forms a flat plane inclined with respect to planes parallel to both the gap direction G and the lateral direction X. The side surfaces 341*a* and 341*b* of the ground base material end portion 341 have a larger inclination angle than the side surface 342*s* of the tapered portion 342 with respect to planes parallel to both the gap direction G and the lateral direction X.

The ground electrode 3 can be formed, for example, by bending an elongated metal plate material in the thickness direction and then forming the side surface 342*s* of the tapered portion 342 and the side surfaces 341*a* and 341*b* of the ground base material end portion 341 by cutting work. The metal member described above has both width-wise end surfaces swelling outward in the width direction but it is not limited to this structure.

As illustrated in FIGS. 2 and 3, the ground protrusion part 32 protrudes from the G2-side surface of the ground base material end portion 341 toward the G2 side. In the present embodiment, the ground base material 31 and the ground protrusion part 32 are separate members. The ground protrusion part 32 has the shape of a triangular prism. The ground protrusion part 32 has a triangular cross section orthogonal to the gap direction G. Specifically, the cross section of the ground protrusion part 32 orthogonal to the gap direction G has a triangular shape that becomes narrower toward the X1 side.

The ground protrusion part 32 has the plurality of side surfaces 322, 323, and 324. In the present embodiment, the ground protrusion part 32 has the three side surfaces 322, 323, and 324. Each of the three side surfaces 322, 323, and 324 has a right angle with the ground discharge surface 321.

The three side surfaces 322, 323, and 324 include the side surface 322 which is parallel to the gap direction G and the vertical direction Y, and the pair of side surfaces 323 and 324 extending toward the X1 side from opposite sides of the side surface 322 in the vertical direction Y. The pair of side surfaces 323 and 324 is formed to approach each other toward the X1 side from the side surface 322 and is inclined with respect to a plane parallel to both the gap direction G and the lateral direction X. The pair of side surfaces 323 and 324 is in contact with each other by the sides opposite to the side surface 322.

Among planar directions parallel to both the lateral direction X and the axial direction, the direction orthogonal to the gap direction G will be defined as an orthogonal direction. As illustrated in FIGS. 2 to 4, at least one of the angles between the plurality of side surfaces 322, 323, and 324 of the ground protrusion part 32 is a ground specific angle 32*a* of the ground protrusion part 32 located at the end opposite to the contact portion 331 side of the orthogonal direction. In the present embodiment, since the orthogonal direction is the lateral direction X, the orthogonal direction will be called lateral direction X. In the present embodiment, the ground specific angle 32*a* is an angle between the pair of side surfaces 323 and 324.

As illustrated in FIGS. 2 to 5, each of the surfaces forming the ground specific angle 32*a* among the side surfaces 322, 323, and 324 of the ground protrusion part 32 (that is, the pair of side surfaces 322 and 323) is flush with the side surface of the ground base material 31. Out of the pair of side surfaces 323 and 324, the one entire side surface 323 is flush in a planar form with the one entire side surface 341*a* of the ground base material end portion 341. The other entire side surface 324 is flush in a planar form with the other entire side surface 341*b* of the ground base material end portion 341.

In the present embodiment, the ground base material end portion 341 entirely overlaps the ground protrusion part 32 in the gap direction G. The cross-sectional shape of the ground base material end portion 341 orthogonal to the gap direction G is the same as the cross-sectional shape of the ground protrusion part 32 orthogonal to the gap direction G. The side surfaces 341*a* and 341*b* of the ground base material end portion 341 are flush with the side surfaces 323 and 324 of the ground protrusion part 32. The entire side surfaces 341*a* and 341*b* of the ground base material end portion 341 are flush with the side surfaces 323 and 324 of the ground protrusion part 32.

As illustrated in FIGS. 2 and 3, the ground specific angle 32*a* is formed in the gap direction G. The angle between the pair of side surfaces 341*a* and 341*b* of the ground base material end portion 341 is also formed in the gap direction G. The angle between the pair of side surfaces 341*a* and 341*b* of the ground base material end portion 341 is smoothly connected to the ground specific angle 32*a* in a linear fashion.

As illustrated in FIG. 2, the protrusion length L1 of the ground protrusion part 32 from the inward-facing part 34 is 0.5 mm or more in the gap direction G. That is, the length L1 of the portion of the ground protrusion part 32 exposed from the inward-facing part 34 in the gap direction G is 0.5 mm or more in the gap direction G. The protrusion length L1 of the ground protrusion part 32 is preferably 1.0 mm or less from the viewpoint of prevention of pre-ignition. Specifically, when the protrusion length L1 becomes larger than 1.0 mm, the position of the ground base material 31 is located closer to the G1 side, that is, closer to the center of the combustion chamber at a relatively high temperature. As a result, when the protrusion length L1 exceeds 1.0 mm, the ground electrode 3 may become high in temperature and cause pre-ignition.

The ground discharge surface 321 of the ground protrusion part 32 is orthogonal to the gap direction G. The ground discharge surface 321 is opposed to the center discharge surface 221 of the center electrode 2 in the gap direction G. The spark discharge gap 13 is formed between the ground discharge surface 321 and the center discharge surface 221 in the gap direction G.

The center base material 21 can be a columnar body made of a metal material such as a Ni based alloy, and have therein a metal material excellent in thermal conductivity such as Cu. The center protrusion part 22 can be made of a noble metal such as Ir or Pt, for example. The ground base material 31 can be made of an Ni base alloy having Ni as the main ingredient, for example. The ground protrusion part 32 can be made of a noble metal such as Ir or Pt, for example.

As illustrated in FIG. 1, inside the insulating glass 12, a resistor 15 is disposed on the G2 side of the center electrode 2 with an electrically-conductive glass seal 14 therebetween. The resistor 15 can be formed by heating and sealing a resistor composite including a resistor material such as carbon or ceramic powder and glass powder, or by inserting a cartridge-type resistor body. The glass seal 14 is made of copper glass in which copper powder is mixed into glass. On the G2 side of the resistor 15, a stem 16 is disposed with a glass seal 17 made of copper glass between the resistor 15 and the stem 16. The stem 16 is made of an iron alloy, for example. The spark plug 1 has the stem 16 connected to an ignition coil.

Next, an ignition device 10 in which the spark plug 1 of the present embodiment is attached to an internal combustion engine as illustrated in FIG. 7 will be described.

The spark plug 1 is disposed in a posture in which the vertical direction Y is the direction of a gas flow F of air-fuel mixture passing through the spark discharge gap 13. Hereinafter, the simple term "downstream side" will refer to the downstream side of the gas flow F of air-fuel mixture flowing in the spark discharge gap 13, and the simple term "upstream side" will refer to the upstream side of the gas flow F of air-fuel mixture flowing in the spark discharge gap 13.

Next, an example of a state in which a discharge spark S between the center electrode 2 and the ground electrode 3 is stretched by the gas flow F will be described with reference to FIGS. 7 to 9.

As illustrated in FIG. 7, applying a predetermined voltage between the center electrode 2 and the ground electrode 3 generates the discharge spark S in the spark discharge gap 13. The initial discharge spark S is likely to occur on the center discharge surface 221 of the center electrode 2 and at the G2-side end portion of the ground specific angle 32*a* of the ground protrusion part 32 as starting points, for example. This is because, in the center electrode 2 and the ground electrode 3, the distance between the center discharge surface 221 and the G2-side end portion of the ground specific angle 32*a* tends to become relatively short and the intensity of an electric field around the G2-side end portion of the ground specific angle 32*a* tends to become relatively high. Hereinafter, the starting point on the center electrode 2 side of the discharge spark S will be called "center electrode-side starting point S2", and the starting point on the ground electrode 3 side of the discharge spark S will be called "ground electrode-side starting point S1".

Figure 8:
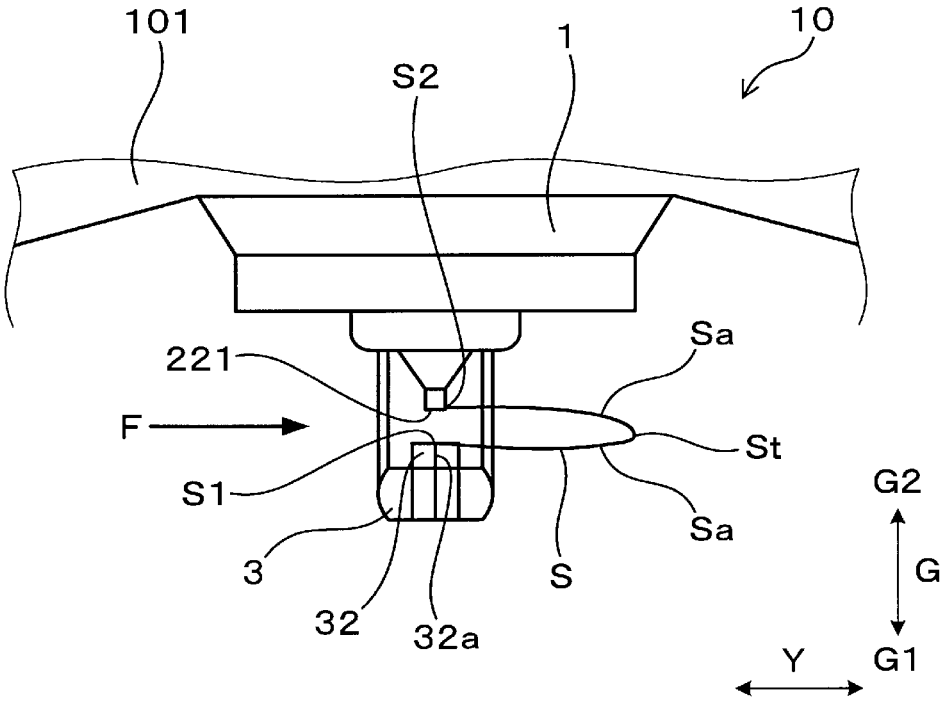
FIG. 8 is an enlarged front view of the tip end portion and its vicinity, in the spark plug in the ignition device in the first embodiment, illustrating a state in which a portion between both starting points of the initial discharge spark is greatly stretched by a gas flow in a combustion chamber.

As illustrated in FIG. 8, when the discharge spark S is blown by the gas flow F, the discharge spark S is extended such that the portion between both starting points swells to the downstream side while at least the position of the ground electrode-side starting point S1 is kept at the G2-side end portion of the ground specific angle 32*a*. As the portion between the both starting points of the discharge spark S is extended downstream, the curvature of a folded portion St as a most downstream portion of the discharge spark S becomes larger. Accordingly, as the portion between both starting points of the discharge spark S is extended downstream, portions Sa adjacent to both sides of the folded portion St of the discharge spark S approach to each other in the gap direction G, and finally cause a short-circuit as illustrated in FIG. 9. This short-circuit makes the discharge spark S slightly shorter in the vertical direction Y. After that, extension of the portion between both starting points of the discharge spark S and short-circuiting are repeated.

Figure 9:
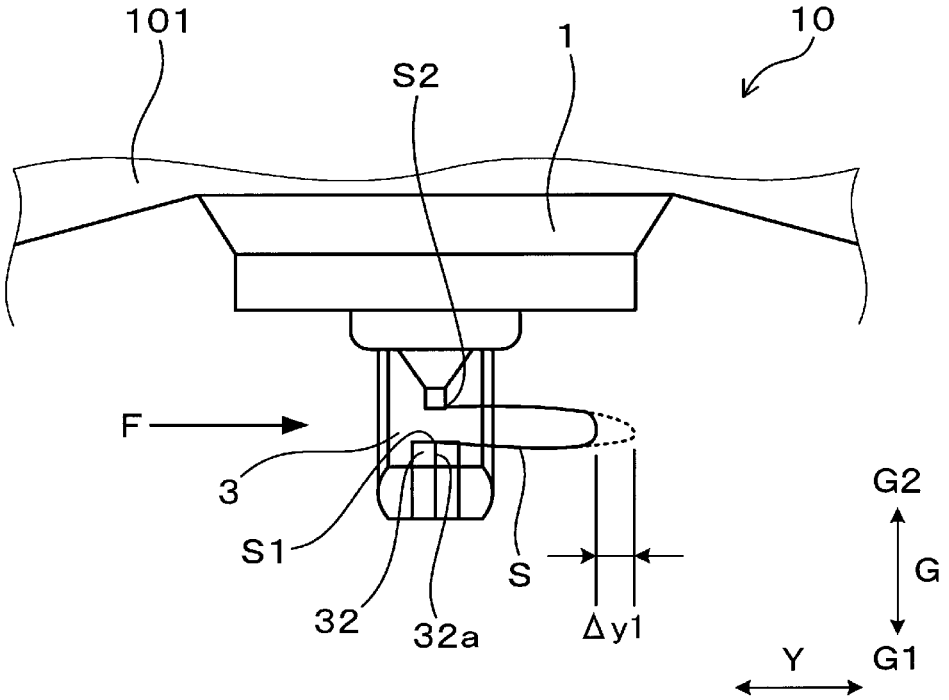
FIG. 9 is an enlarged front view of the tip end portion and its vicinity, in the spark plug in the ignition device in the first embodiment, illustrating a discharge spark immediately before a short-circuit and a discharge spark immediately after the short-circuit.

FIG. 9 shows the discharge spark immediately before the short-circuit by a dashed line, and the discharge spark S immediately after the short-circuit is shown by a solid line. In addition, FIG. 9 shows a length from the position of the downstream-side end portion of the discharge spark S immediately before the short-circuit of the discharge spark S to the position of the downstream-side end portion of the discharge spark S immediately after the short-circuit of the discharge spark S in the vertical direction Y with the symbol $\Delta y1$.

Next, the actions and effects of the present embodiment will be described.

In the spark plug 1 for internal combustion engine, the protrusion length L1 of the ground protrusion part 32 from the ground base material 31 is 0.5 mm or more in the gap direction G. This makes it possible to suppress the movement of the ground electrode-side starting point S1 of the discharge spark S generated in the spark discharge gap 13 from the ground protrusion part 32 to the ground base material 31. This suppresses an increase in the distance between the starting points of the discharge spark in the gap direction G. Accordingly, the portion between both starting points of the discharge spark S is folded at a steep angle at the downstream-side end portion and is extended in a sharp shape toward the downstream side as a whole. Thus, when the portion between the both starting points of the discharge spark S is extended to the downstream side, that portion tends to be partially short-circuited with another portion. This makes blow-off and re-discharge of the discharge spark S less prone to occur. This numerical value will be supported by experimental examples described later.

The angles between the ground discharge surface 321 of the ground protrusion part 32 opposed to the spark discharge gap 13 and the side surfaces 322, 323, and 324 of the ground protrusion part 32 are right angles. This makes it easy to ensure the intensity of an electric field around the angles between the ground discharge surface 321 and the side surfaces 322, 323, and 324 of the ground protrusion part 32. Accordingly, it is possible to easily keep the ground electrode-side starting point S1 of the discharge spark S at the angles between the ground discharge surface 321 and the side surfaces 322, 323, and 324 of the ground protrusion part 32, and suppress the movement of the ground electrode-side starting point S1 of the discharge spark S to the ground base material 31. This also suppresses the blow-off and re-discharge of the discharge spark S.

At least some portions of the side surfaces 322, 323, and 324 of the ground protrusion part 32 and at least a portion of the side surface of the ground base material 31 are flush with each other. This suppresses concentration of an electric field around the portion of the ground base material 31 where the ground protrusion part 32 is disposed. This suppresses movement of the ground electrode-side starting point S1 of the discharge spark S from the ground protrusion part 32 to the ground base material 31. This also suppresses the blow-off and re-discharge of the discharge spark S.

At least one of the angles between the plurality of side surfaces 322, 323, and 324 of the ground protrusion part 32 is the ground specific angle 32*a* that is located at the end portion of the ground protrusion part opposite to the connection part 331 side of the lateral direction X. That is, the ground protrusion part 32 has the angle around which an electric field tends to concentrate, formed at the end portion of the ground protrusion part 32 opposite to the connection part 331 side of the lateral direction X. This suppresses movement of the ground electrode-side starting point S1 of the discharge spark S from the ground protrusion part 32 to the portion of the ground base material 31 on the X2 side of the lateral direction X of the ground protrusion part 32. This also suppresses a flame-out effect in which the heat of a flame generated by ignition of the discharge spark S to the air-fuel mixture is lost to the ground electrode 3 caused by the discharge spark S approaching the portion of the ground electrode 3 on the X2 side of the lateral direction X of the ground protrusion part 32. Each of the side surfaces 323 and 324 forming the ground specific angle 32*a* among the side surfaces 322, 323, and 324 of the ground protrusion part 32 is flush with the side surface of the ground base material 31. Therefore, the ground electrode-side starting point S1 of the discharge spark S can be more easily kept at the G2-side end portion of the ground specific angle 32*a* formed on the X1-side end portion of the lateral direction X.

The side surfaces 341*a* and 341*b* of the ground base material end portion 341 are flush with the side surfaces 323 and 324 of the ground protrusion part 32. This makes it possible to prevent the formation of a portion around which an electric field tends to concentrate between the side surfaces 341*a* and 341*b* of the ground base material end portion 341 and the side surfaces 323 and 324 of the ground protrusion part 32. Therefore, the ground electrode-side starting point S1 of the discharge spark S is further easy to keep on the ground discharge surface 321.

The ground protrusion part 32 has a triangular cross section orthogonal to the gap direction G. This makes it easy to form an angle in the ground protrusion part 32 around which an electric field tends to concentrate. This makes it easy to suppress movement of the ground electrode-side starting point S1 of the discharge spark S from the ground protrusion part 32 to the ground base material 31.

As described above, according to the present embodiment, it is possible to provide a spark plug for internal combustion engine that is less prone to cause re-discharge.

Comparative Embodiment

Figure 10:
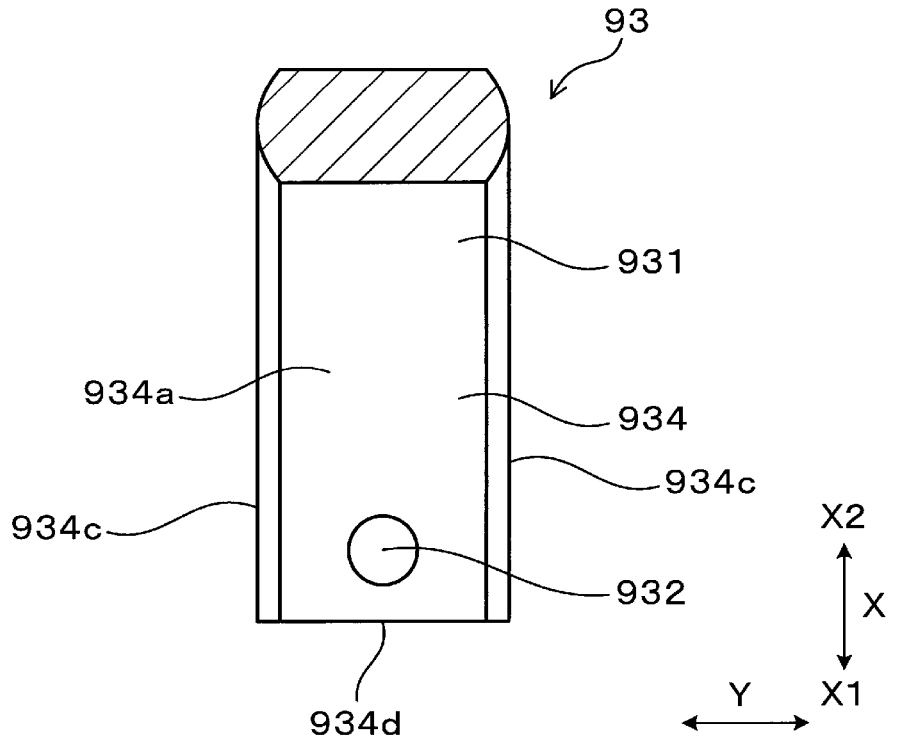
FIG. 10 is a partial cross-sectional view of a ground electrode as seen from a center electrode side in a comparative embodiment.
Figure 11:
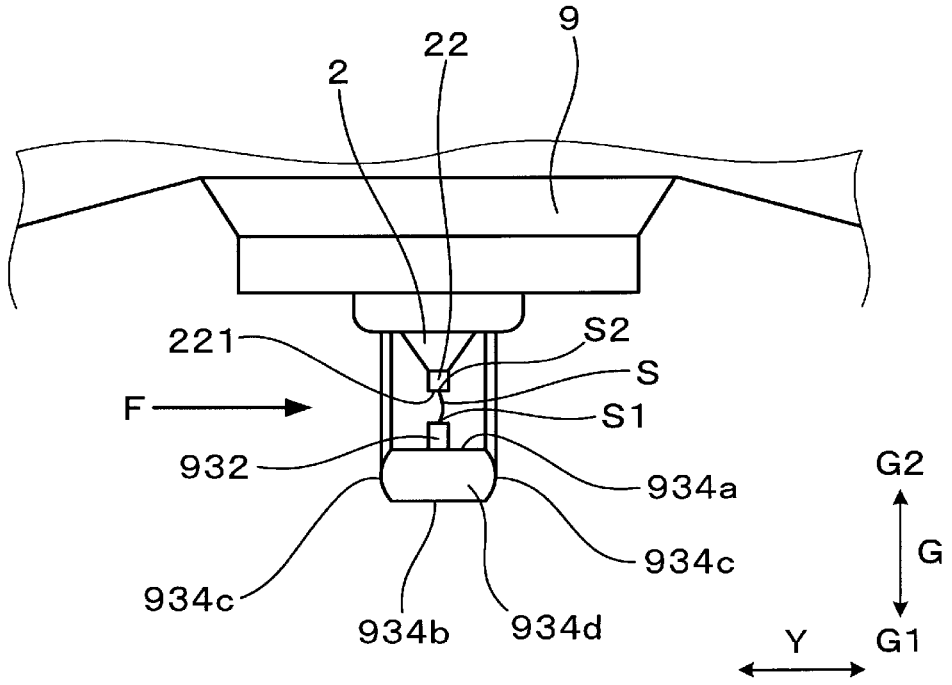
FIG. 11 is an enlarged front view of a tip end portion and its vicinity, in a spark plug in an ignition device in the comparative embodiment, illustrating an initial discharge spark.

The present comparative embodiment is an embodiment in which the first embodiment is modified in the configuration of the ground electrode as illustrated in FIGS. 10 to 13. Specifically, the inward-facing part and the ground protrusion part in the first embodiment are modified as illustrated in FIGS. 10 and 11. As illustrated in FIG. 10, in the present comparative embodiment, an inward-facing part 934 is uniformly formed such that the width in the vertical direction Y becomes constant in the lateral direction X. The inward-facing part 934 has an inside surface 934*a* oriented toward the G2 side, an outside surface 934*b* oriented toward the G1 side (see FIG. 11), a pair of first side surfaces 934*c* connecting the inside surface 934*a* and the outside surface 934*b* at both ends in the vertical direction Y, and a second side surface 934*d* connecting the inside surface 934*a* and the outside surface 934*b* on an X1-side end portion. The first side surface 934*c* is oriented toward the vertical direction Y, and the second side surface 934*d* is oriented toward the X1 side of the lateral direction X.

A columnar ground chip 932 is disposed on the inside surface 934*a* of the inward-facing part 934. As illustrated in FIG. 11, the ground chip 932 is opposed to the center discharge surface 221 of the center protrusion part 22 in the gap direction G. In the present comparative embodiment, the side surface of the ground chip 932 is not flush with the side surface of a ground base material 931. As seen from the gap direction G, the outer shape of the ground chip 932 is within the pair of the first side surface 934*c* and the second side surface 934*d* of the inward-facing part 934. As seen in the gap direction G, the outer shape of the ground chip 932 does not overlap either of the pair of the first side surface 934*c* and the second side surface 934*d*. As seen from the gap direction G, the angle between the inside surface 934*a* and the first side surface 934*c* of the inward-facing part 934, the angle between the inside surface 934*a* and the second side surface 934*d*, and the angle between the first side surface 934*c* and the second side surface 934*d* are located on the X1 side of the ground chip 932. In the other respects, the present comparative embodiment is the same in basic structure as the first embodiment.

Next, an example of a spark plug 9 in the present comparative embodiment in which the discharge spark S is extended by the gas flow F in the combustion chamber will be described with reference to FIGS. 11 to 13.

As illustrated in FIG. 11, the initial discharge spark S is generated between the center discharge surface 221 and the G2-side surface of the ground chip 932. The discharge spark S is blown by the gas flow F and has the portion between the both starting points significantly swelling to the downstream side. As illustrated in FIGS. 11 and 12, while the portion between the both starting points of the discharge spark S swells to the downstream side, the ground electrode-side starting point S1 of the discharge spark S is blown and moved by the gas flow F.

First, the ground electrode-side starting point S1 of the discharge spark S moves from the ground chip 932 to the G2-side end portion at the angle between the first side surface 934*c* and the second side surface 934*d* around which an electric field tends to concentrate.

Figure 12:
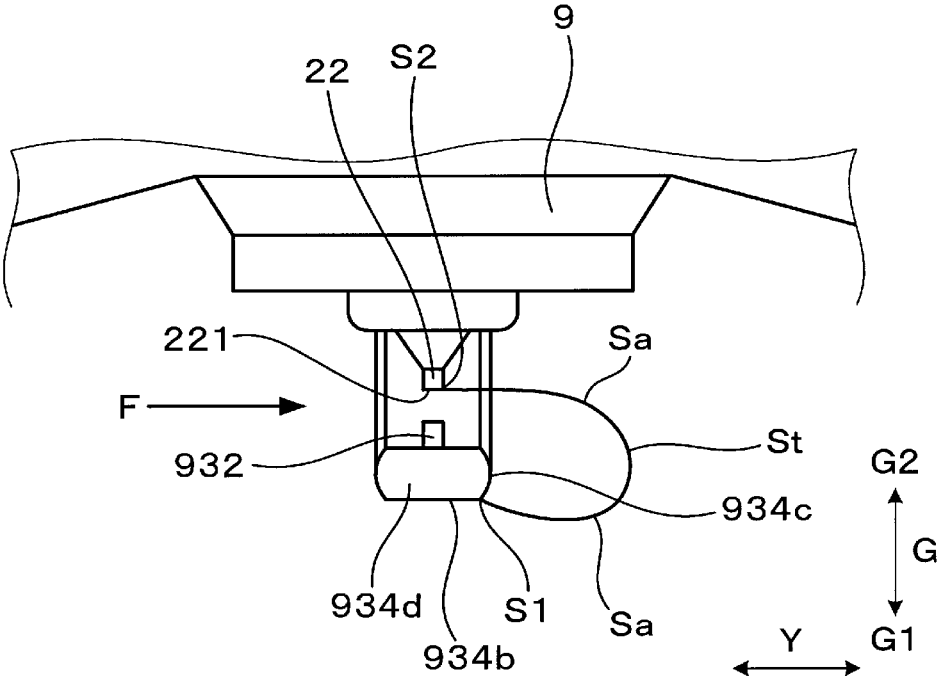
FIG. 12 is an enlarged front view of the tip end portion and its vicinity, in the spark plug in the ignition device in the comparative embodiment, illustrating a state in which a portion between both starting points of the initial discharge spark is greatly stretched by a gas flow in a combustion chamber.

Then, the ground electrode-side starting point S1 of the discharge spark S is further blown by the gas flow F to move to the G1 side over the angle between the first side surface 934*c* and the second side surface 934*d*, and reaches the G1-side end portion at the angle between the first side surface 934*c* and the second side surface 934*d* as illustrated in FIG. 12.

In this manner, the portion between the both starting points of the spark plug S significantly swells to the downstream side with an increase in the distance between the both starting points of the discharge spark S in the gap direction G. Accordingly, as illustrated in FIG. 12, even when the portion between the both starting points of the discharge spark S is extended downstream, the curvature of the folded portion St as the most downstream portion of the discharge spark S is less prone to increase. Since portions Sa adjacent to the folded portion St of the discharge spark S are unlikely to approach to each other and cause a short-circuit, the discharge spark S is excessively extended downstream until being blown off.

Figure 13:
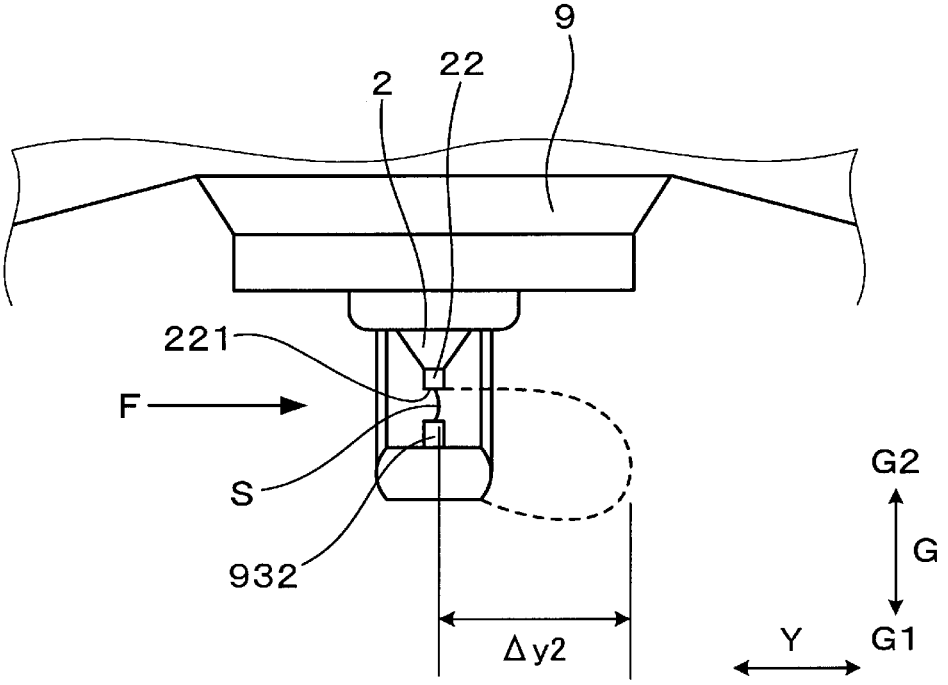
FIG. 13 is an enlarged front view of the tip end portion and its vicinity, in the spark plug in the ignition device in the comparative embodiment, illustrating a discharge spark immediately before a short-circuit and a discharge spark immediately after the short-circuit.

Then, as illustrated in FIG. 13, the discharge spark S excessively stretched to the downstream side is finally blown off, and re-discharge occurs between the center discharge surface 221 of the center electrode 2 and the G2-side end surface of the ground chip 932. After that, the stretch of the portion between the both starting points of the discharge spark S, the blow-off, and the re-discharge are repeated.

FIG. 13 shows the discharge spark immediately before blow-off by a dashed line and shows the discharge spark S immediately after re-discharge by a solid line. FIG. 13 also shows a length, in the vertical direction Y, from the position of the downstream-side end portion of the discharge spark S immediately before blow-off to the position of the downstream-side end portion of the discharge spark S immediately after re-discharge with the symbol Δy2.

In the present comparative embodiment, blow-off and re-discharge of the discharge spark are likely to occur. Therefore, as illustrated in FIG. 13, the length Δy2 in the vertical direction Y from the position of the downstream-side end portion of the discharge spark immediately before the blow-off to the position of the downstream-side end portion of the discharge spark S immediately after the re-discharge tends to be relatively long. That is, in the present comparative embodiment, the position of the downstream-side end portion of the discharge spark S tends to change. Thus, the movement of heat from the discharge spark S to the air-fuel mixture in the combustion chamber does not take place efficiently. This makes it difficult to improve the ignitability of the air-fuel mixture.

On the other hand, in the spark plug 1 of the first embodiment, the blow-off and re-discharge are unlikely to occur. As illustrated in FIG. 9, the length Δy1 in the vertical direction Y from the position of the downstream-side end portion of the discharge spark S immediately before the short-circuit of the discharge spark S to the position of the downstream-side end portion of the discharge spark S immediately after the short-circuit of the discharge spark S is unlikely to become long. Therefore, the movement of heat from the discharge spark S to the air-fuel mixture in the combustion chamber efficiently takes place to improve the ignitability in an easy manner.

In addition, in the present comparative embodiment, the re-discharge of the discharge spark S tends to occur and wear-out the center electrode and the ground electrode tends to increase. On the other hand, in the spark plug 1 of the first embodiment, the re-discharge is unlikely to occur so that wear of the center electrode 2 and the ground electrode 3 can be suppressed.

First Experimental Example

Figure 14:
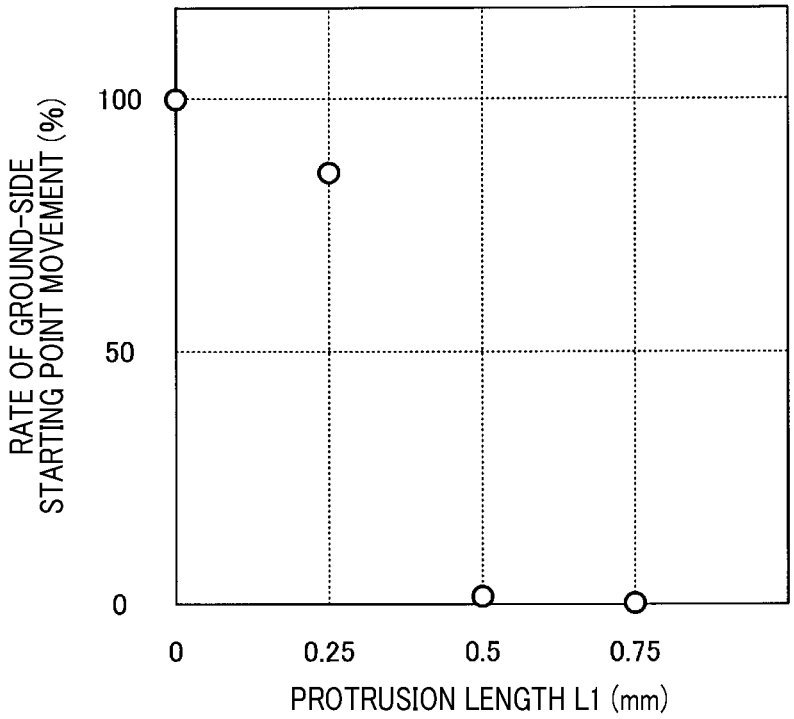
FIG. 14 is a diagram illustrating a relationship between a protrusion length L1 and a ground-side starting point movement ratio in a first experimental example.

The present example is an example of a spark plug similar in basic structure to the first embodiment in which the relationship between the protrusion length L1 and the rate of ground-side starting point movement described later is evaluated as illustrated in FIG. 14. The ground-side starting point movement rate is the rate of movement of the ground electrode-side starting point of the discharge spark from the ground protrusion part 32 to the ground base material 31, which was obtained by observing the discharge caused 20 times between the center electrode and the ground electrode.

In the present example, four samples were prepared, which were similar in basic structure to the spark plug 1 in the first embodiment and had protrusion lengths L1 of 0 mm, 0.25 mm, 0.5 mm, and 0.75 mm.

In the present example, each of the samples was installed in a test device simulating a combustion chamber. Each of the samples was installed in the test device, in a posture in which a flow of air-fuel mixture to pass through the spark discharge gap 13 of the sample is oriented in the vertical direction Y. Then, an air-fuel mixture was supplied at a flow rate of 20 m/s toward the spark discharge gap 13 of each of the samples under a pressure of 0.5 MPa in the device. Discharge was caused 20 times in each of the samples for a discharge time of 1.5 ms to measure the ground-side starting point movement rate. FIG. 14 shows the results.

As can be seen from FIG. 14, when the protrusion length L1 is 0.5 mm or more, the ground-side starting point movement rate becomes as small a value as approximately 0%. On the other hand, when the protrusion length L1 is 0.25 mm or less, the ground-side starting point movement rate rises sharply as compared to the case in which the protrusion length L1 is 0.5 mm or more. That is, from the viewpoint of reducing the ground-side starting point movement rate, the protrusion length L1 of the ground protrusion part 32 from the ground base material 31 in the gap direction G is preferably 0.5 mm or more.

Figure 15:
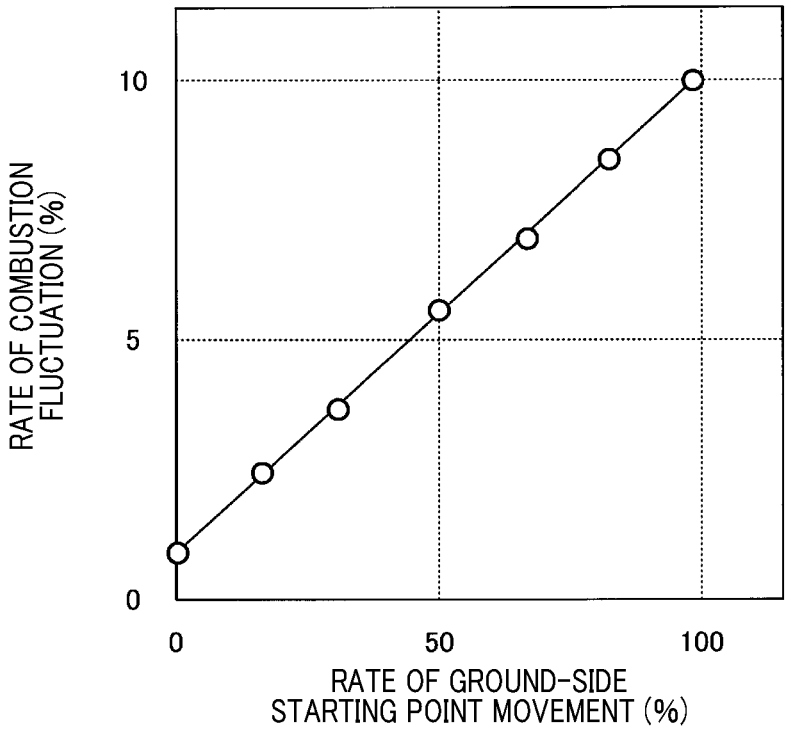
FIG. 15 is a diagram illustrating a relationship between the rate of ground-side starting point movement and the rate of combustion fluctuation in the first experimental example.

Next, as illustrated in FIG. 15, the relationship between the rate of ground-side starting point movement and the rate of combustion fluctuation was examined. The rate of combustion fluctuation is represented by indicated mean effective pressure (IMEP) (standard deviation/average)×100. As the ignitability of the spark plug is higher, the value of the combustion fluctuation rate is lower.

In the present example, various samples different in the rate of ground-side starting point movement were prepared. Each of the samples was installed in a 2.5-L four-cylinder supercharged engine. Then, the rate of combustion fluctuation was measured under the conditions that the engine speed was 1200 rpm and the brake mean effective pressure (BMEP) was 0.5 MPa. FIG. 15 shows the results.

As can be seen from FIG. 15, the lower the rate of ground-side starting point movement, the lower the rate of combustion fluctuation becomes. That is, the lower the rate of ground-side starting point movement, the better the ignitability becomes.

As above, it can be seen from FIG. 15 that, the lower the rate of ground-side starting point movement, the more the ignitability becomes improved, and it can be seen from FIG. 14 that, from the viewpoint of reducing the rate of ground-side starting point movement, the protrusion length L1 of the ground protrusion part 32 from the ground base material 31 in the gap direction G is preferably 0.5 mm or more. That is, from the viewpoint of improving the ignitability, the protrusion length L1 of the ground protrusion part 32 from the ground base material 31 in the gap direction G is preferably 0.5 mm or more.

Second Embodiment

Figure 16:
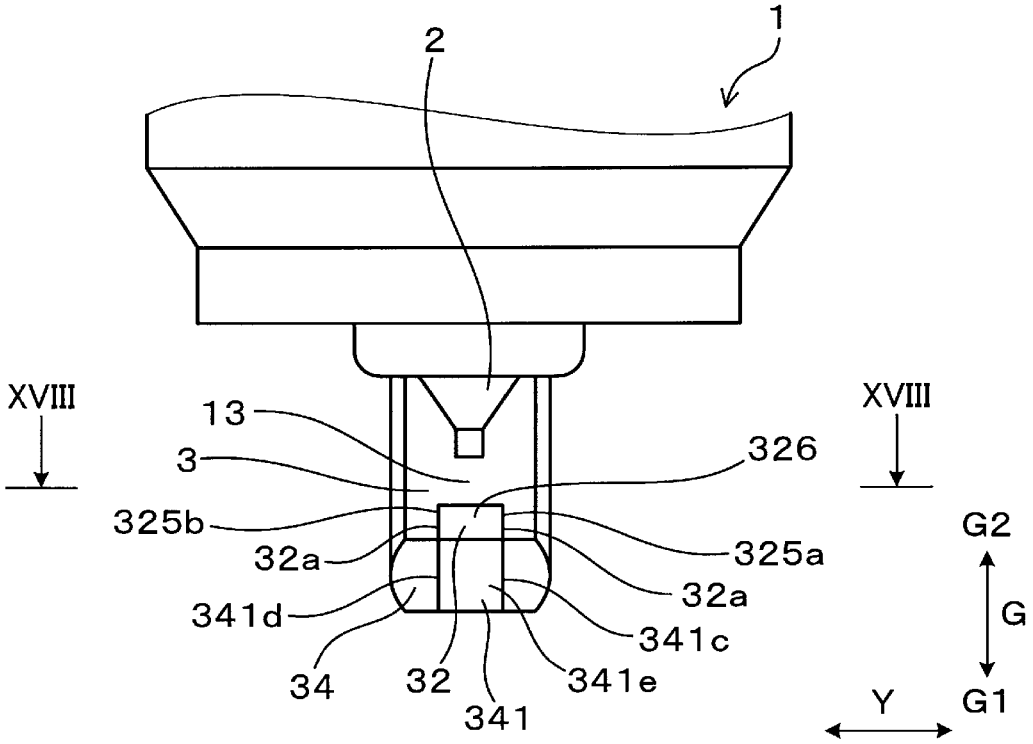
FIG. 16 is a diagram of a tip end portion and its vicinity, in spark plug in a second embodiment as seen from a lateral direction.
Figure 17:
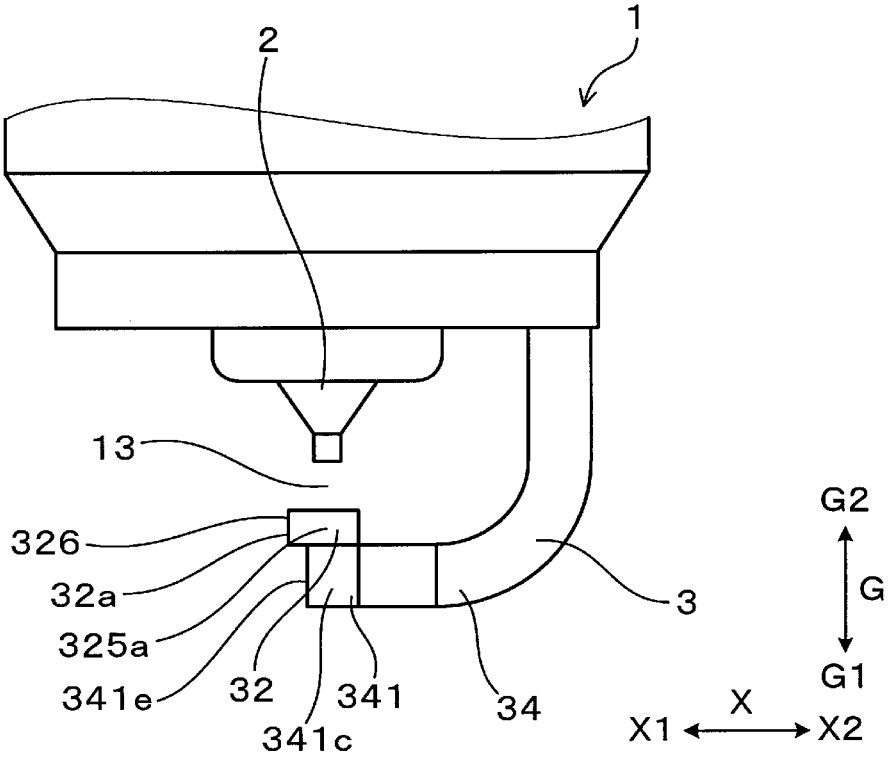
FIG. 17 is a diagram of the tip end portion and its vicinity, in the spark plug in the second embodiment as seen from a vertical direction.
Figure 18:
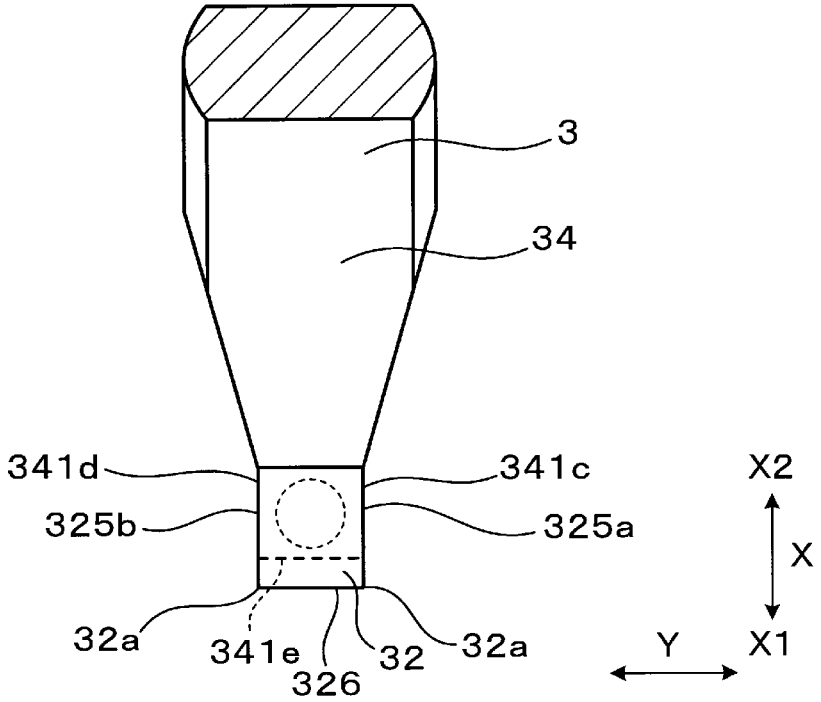
FIG. 18 is an arrow cross-sectional view of FIG. 16 taken along line XVIII-XVIII.

The present embodiment is an embodiment obtained by modifying the shape of the ground electrode 3 in the first embodiment, as illustrated in FIGS. 16 to 18. First, in the present embodiment, the cross section of the ground base material end portion 341 orthogonal to the gap direction G has a square shape. Side surfaces 341*c* and 341*d* of the ground base material end portion 341 on both sides in the vertical direction Y are orthogonal to the vertical direction Y, and a side surface 341*e* of the ground base material end portion 341 on the X1 side is orthogonal to the lateral direction X.

The ground protrusion part 32 has a square prism shape. That is, the cross section of the ground protrusion part 32 orthogonal to the gap direction G has a square shape. As illustrated in FIG. 17, the cross section of the ground protrusion part 32 orthogonal to the gap direction G is longer than the ground base material end portion 341 in the lateral direction X.

As illustrated in FIG. 16, the side surfaces 325*a* and 325*b* of the ground protrusion part 32 on both sides are flush with the side surfaces 341*c* and 341*d* of the ground base material end portion 341 on both sides in the vertical direction Y. Specifically, a portion of the one side surface 325*a* of the ground protrusion part 32 in the vertical direction Y is flush in a planar form with the one entire side surface 341*c* of the ground base material end portion 341 in the vertical direction Y. In addition, a portion of the other side surface 325*b* of the ground protrusion part 32 is flush in a planar form with the other entire side surface 341*d* of the ground base material end portion 341 in the vertical direction Y.

The ground protrusion part 32 is more protruded toward the X1 side of the lateral direction X than the inward-facing part 34 is. That is, the side surface 326 of the ground protrusion part 32 on the X1 side is located further to the X1 side than the side surface 341*e* of the ground base material end portion 341 is on the X1 side. FIG. 18 shows the side surface 341*e* of the ground base material end portion 341 on the X1 side by a dashed line.

In the present embodiment, at least one of the angles between the plurality of side surfaces 325*a*, 325*b*, and 326 of the ground protrusion part 32 is the ground specific angle 32*a* located at the end portion of the ground protrusion part 32 opposite to the connection part 331 side of the lateral direction X. In the present embodiment, there are two ground specific angles 32*a* between the side surface 326 and the pair of side surfaces 325*a* and 325*b* of the ground protrusion part 32. That is, the present embodiment has the two ground specific angles 32*a*. The ground protrusion part 32 has the angles between the side surfaces 325*a* and 325*b*, which are on opposite sides in the vertical direction Y, and the side surface 326 on the X1 side, closer to the X1 side than to the side surface 341*e* of the ground base material end portion 341 on the X1 side.

In other respects, the second embodiment is similar to the first embodiment

Out of the reference signs used in the second and subsequent embodiments, the ones identical to the reference signs used in the embodiment already described represent constituent elements similar to those of the embodiment already described, unless otherwise specified.

In the present embodiment, the cross section of the ground protrusion part 32 orthogonal to the gap direction G has a square shape. Therefore, it is easy to provide the ground protrusion part 32 with angles around which an electric field tends to concentrate. This makes it easy to suppress the movement of the ground electrode-side starting point of the discharge spark from the ground protrusion part 32 to the ground base material 31.

The ground protrusion part 32 protrudes more to the X1 side than the X1-side end surface of the inward-facing part 34 does. The ground protrusion part 32 has the angles between the side surfaces 325 on the both sides in the vertical direction Y and the side surface 326 on the X1 side more protruding to the X1 side than the X1-side end portion of the inward-facing part 34. Therefore, it is easy to further suppress the movement of the ground electrode-side starting point S1 of the discharge spark S from the angles of the ground protrusion part 32 between the side surfaces 325 of the ground protrusion part 32 on both sides in the vertical direction Y and the side surface 326 on the X1 side to the ground base material 31.

In other respects, the second embodiment exhibits actions and effects similar to those of the first embodiment.

Third Embodiment

The present embodiment is an embodiment obtained by modifying the shape of the ground electrode 3 of the first embodiment, as illustrated in FIGS. 19 to 22. In the present embodiment, the angle between the ground discharge surface 321 and at least one of side surfaces 328 and 329 of the ground protrusion part 32 is an acute angle.

Figure 21:
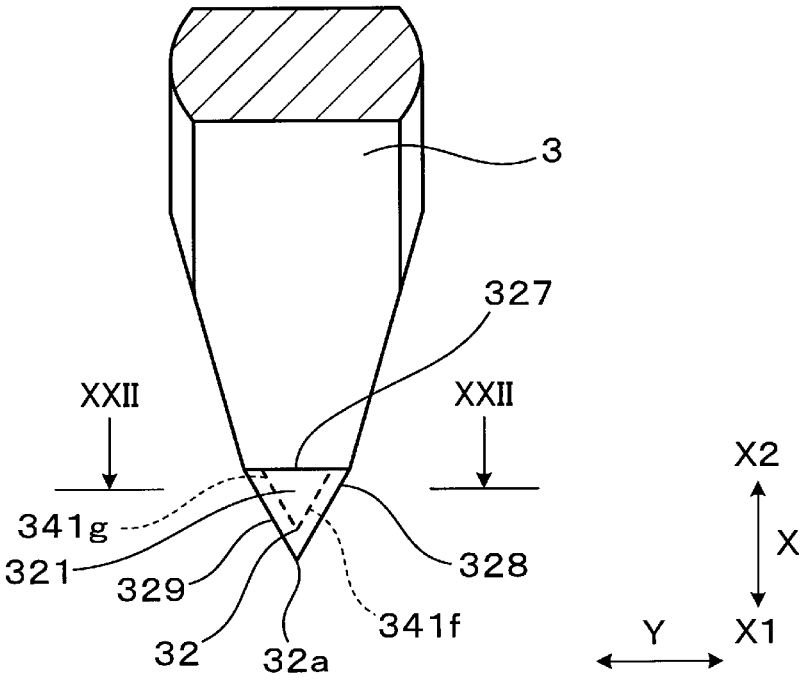
FIG. 21 is an arrow cross-sectional view of FIG. 19 taken along line XXI-XXI.
Figure 22:
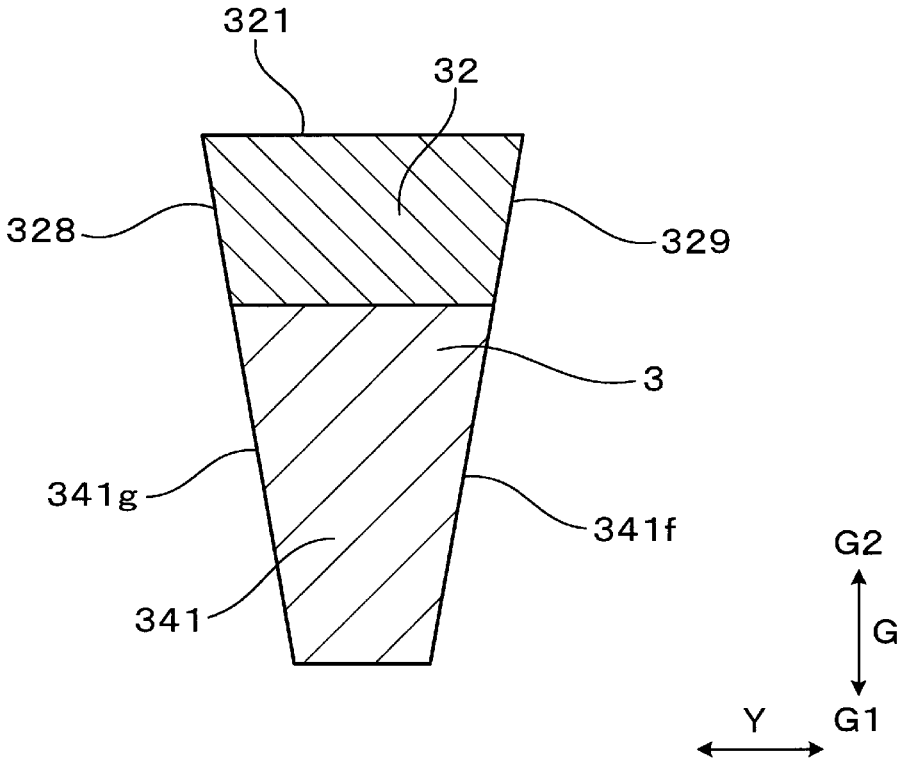
FIG. 22 is an arrow cross-sectional view of FIG. 21 taken along line XXII-XXII.

As illustrated in FIG. 21, the cross section of the ground protrusion part 32 orthogonal to the gap direction G has a triangular shape as in the first embodiment, and the ground protrusion part 32 has three side surfaces 327, 328, and 329. The three side surfaces 327, 328, and 329 include the side surface 327 parallel to the gap direction G and the vertical direction Y and the pair of side surfaces 328 and 329 extended from the opposite sides of the side surface 327 in the vertical direction Y, towards the X1 side. The pair of side surfaces 328 and 329 come closer to each other toward the X1 side from the side surface 327, and are inclined with respect to a plane parallel to both the gap direction G and the lateral direction X. As illustrated in FIG. 22, in the present embodiment, the pair of side surfaces 328 and 329 of the ground protrusion part 32 are inclined to approach each other toward the G1 side. That is, the angles between the ground discharge surface 321 and the side surfaces 328 and 329 of the ground protrusion part 32 are acute angles. In addition, the angle between the ground discharge surface 321 and the side surface 327 of the ground protrusion part 32 is a right angle.

As in the first embodiment, the cross section of the ground base material end portion 341 orthogonal to the gap direction G has a triangular shape. A pair of side surfaces 341*f* and 341*g* of the ground base material end portion 341 are inclined to approach each other toward the G1 side. FIG. 21 shows G1-side end edges of the pair of side surfaces 341*f* and 341*g* of the ground base material end portion 341 by a dashed line. In other words, FIG. 21 shows the outer shape of the G1-side surface of the ground base material end portion 341 by a dashed line.

The pair of side surfaces 328 and 329 of the ground protrusion part 32 are flush with the side surfaces of 341*f* and 341*g* of the ground base material end portion 341. That is, the entire side surface 328 of the ground protrusion part 32 is flush in a planar form with the entire side surface 341*f* of the ground base material end portion 341, and the other entire side surface 329 is flush in a planar form with the other entire side surface 341*g* of the ground base material end portion 341. In addition, the side surface 328 of the ground protrusion part 32 and the side surface 341*f* of the ground base material end portion 341 adjacent to each other, and the side surface 329 of the ground protrusion part 32 and the side surface 341*g* of the ground base material end portion 341 adjacent to each other, are flush with each other in a planar form in such a manner as to approach to the inside in the vertical direction Y toward the G1 side.

Figure 19:
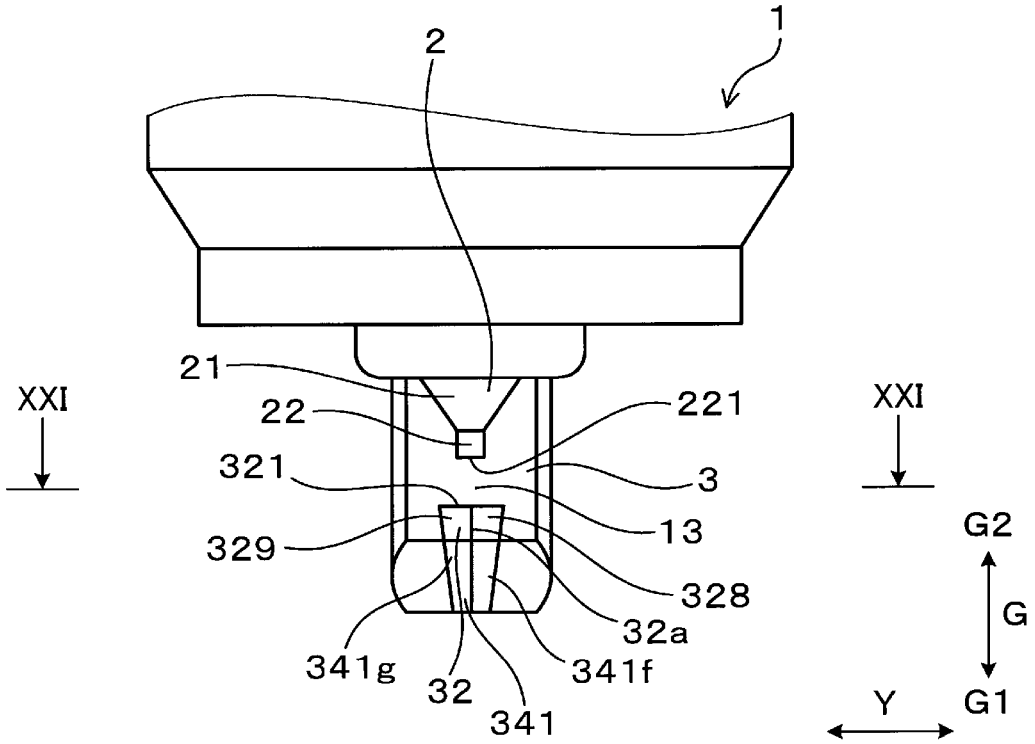
FIG. 19 is a diagram of a tip end portion and its vicinity, in a spark plug in a third embodiment as seen from a lateral direction.
Figure 20:
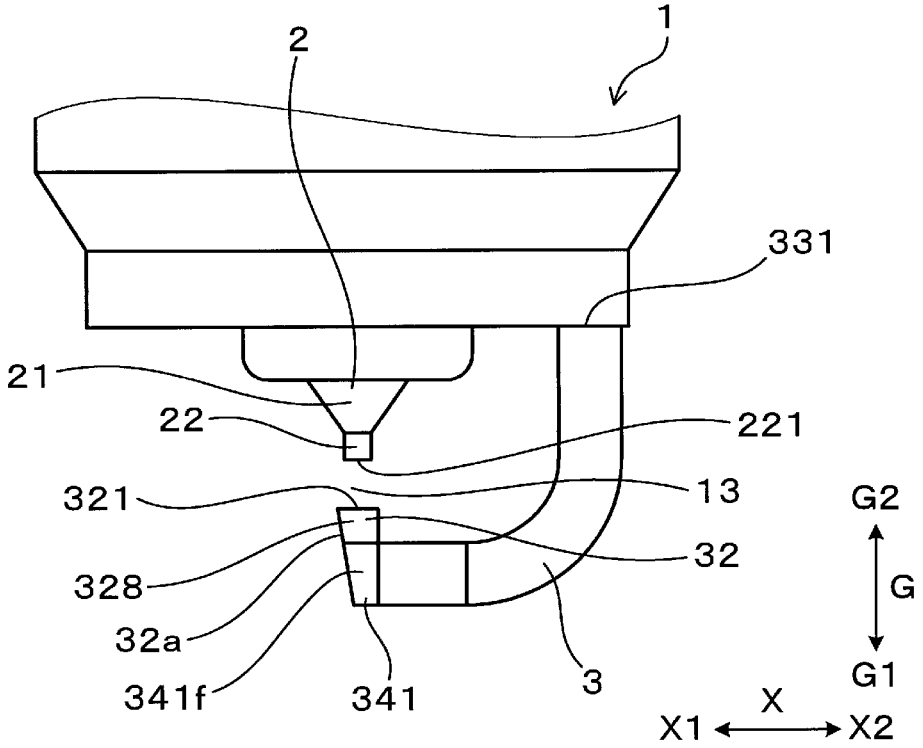
FIG. 20 is a diagram of the tip end portion and its vicinity, in the spark plug in the third embodiment as seen from a vertical direction.

As illustrated in FIGS. 19 to 21, in the present embodiment, the angle between the pair of side surfaces 328 and 329 of the ground protrusion part 32 is the ground specific angle 32*a* located at the end portion of the ground protrusion part 32 opposite to the connection part 331 side of the lateral direction X. As illustrated in FIG. 20, the ground specific angle 32*a* is inclined to approach the X2 side toward the G1 side. In addition, the angle between the side surfaces 341*f* and 341*g* of the ground base material end portion 341 is also inclined toward the X2 side toward the G1 side. The ground specific angle 32*a* and the angle between the side surfaces 341*f* and 341*g* of the ground base material end portion 341 are smoothly connected in a linear fashion.

In other respects, the third embodiment is similar to the first embodiment.

In the present embodiment, the angle between the ground discharge surface 321 and at least one of the side surfaces 328 and 329 of the ground protrusion part 32 is an acute angle. This makes it easy to concentrate an electric field around the angle between the ground discharge surface 321 and at least one of the side surfaces 328 and 329 of the ground protrusion part 32. This makes it easy to keep the ground electrode-side starting point of the discharge spark at the angle between the ground discharge surface 321 and at least one of the side surfaces 328 and 329 of the ground protrusion part 32.

In other respects, the third embodiment exhibits actions and effects similar to those of the first embodiment.

Fourth Embodiment

Figure 23:
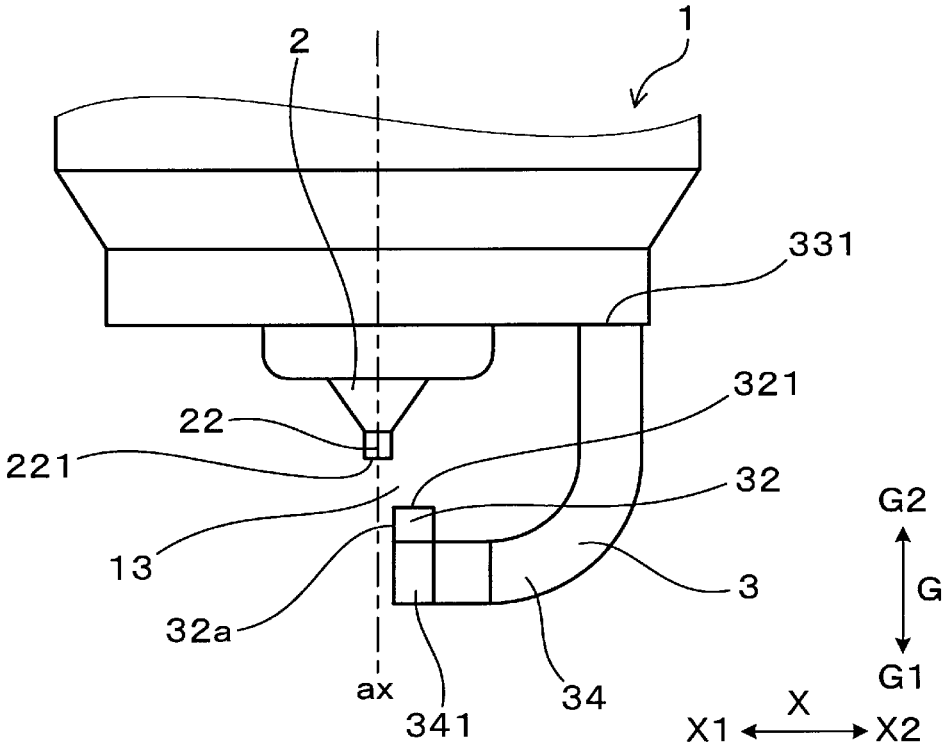
FIG. 23 is a diagram of a tip end portion and its vicinity, in a spark plug in a fourth embodiment as seen from a vertical direction.

In the present embodiment, as illustrated in FIG. 23, an end edge of the ground electrode 3 opposite to the connection part 331 side in the lateral direction X is located closer to the connection part 331 side of the lateral direction X than an axis ax of the center electrode 2 is. That is, an X1-side end portion of the ground protrusion part 32 and an X1-side end portion of the inward-facing part 34 are located on an X2 side of the axis ax in the lateral direction X. FIG. 23 shows the axis ax of the center electrode 2 from the vertical direction Y by a dot-and-dash line.

In other respects, the fourth embodiment is similar to the first embodiment.

In the present embodiment, it is easy to generate the ground electrode-side starting point of the discharge spark at the X1-side end portion of the ground discharge surface 321. This makes it easy to suppress the movement of the ground electrode-side starting point of the discharge spark from the ground discharge surface 321 of the ground protrusion part 32 closer to the X2 side than the ground discharge surface 321 of the inward-facing part 34.

In other respects, the fourth embodiment exhibits actions and effects similar to those of the first embodiment.

Fifth Embodiment

The present embodiment is similar in basic structure to the first embodiment and is further devised in the shape of the center electrode 2 as illustrated in FIGS. 24 to 28.

As illustrated in FIGS. 24, 25, 27, and 28, a base material tip end portion 210 of the center base material 21 has a base material diameter-reduced portion 211 that is more reduced in diameter toward the G1 side and a base material extension portion 212 that is extended to the gap direction G from the base material diameter-reduced portion 211 to the G1 side. The base material extension portion 212 has a square prism shape. That is, the cross section of the base material extension portion 212 orthogonal to the gap direction G has a square shape. In addition, the cross section of the base material diameter-reduced portion 211 orthogonal to the gap direction G has a square shape. Four side surfaces 211*a* of the base material diameter-reduced portion 211 are flush with four side surfaces 212*a* of the base material extension portion 212.

The center protrusion part 22 has a square prism shape. That is, the cross section of the center protrusion part 22 orthogonal to the gap direction G has a square shape. The cross section of the center protrusion part 22 orthogonal to the gap direction G is the same in shape as the cross section of the base material extension portion 212 orthogonal to the gap direction G.

Figure 26:
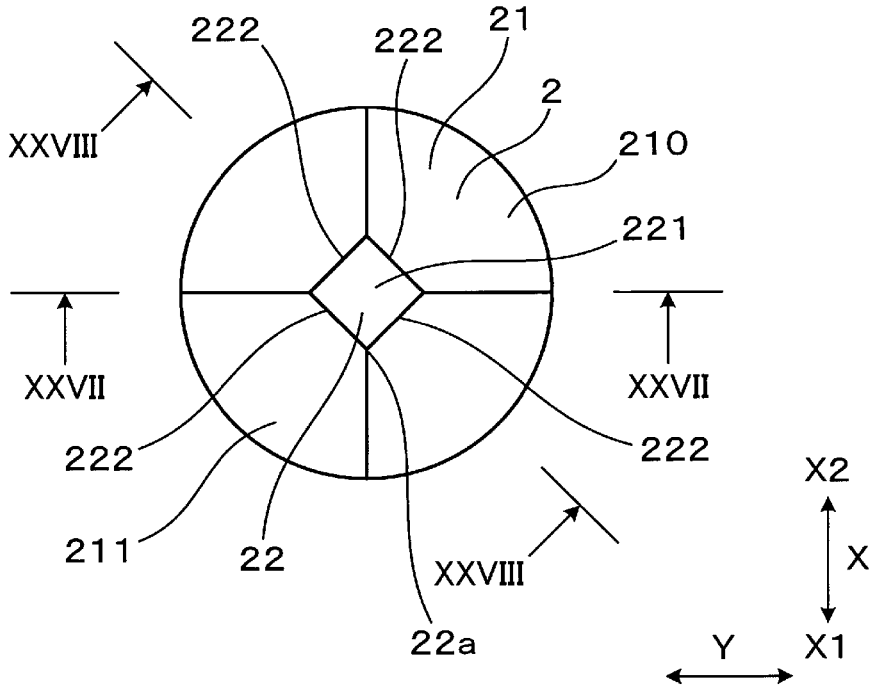
FIG. 26 is a diagram of a tip end portion of a center electrode in the fifth embodiment as seen from a ground electrode side in a gap direction.
Figure 28:
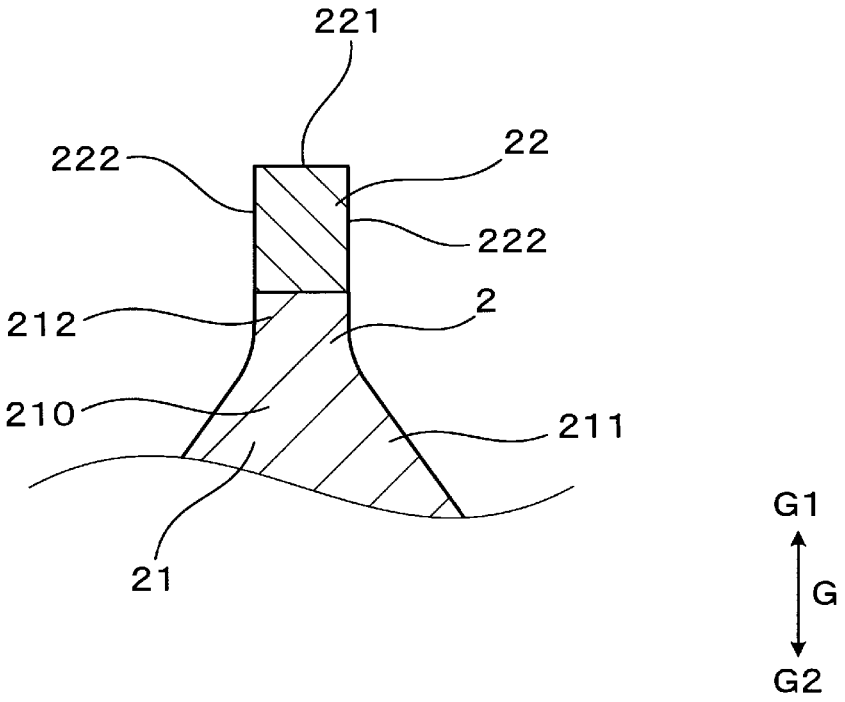
FIG. 28 is an arrow cross-sectional view of FIG. 26 taken along line XXVIII-XXVIII.

As illustrated in FIG. 26, the center protrusion part 22 has four side surfaces 222. As illustrated in FIG. 28, the angles between the center discharge surface 221 of the center protrusion part 22 and the side surface 222 of the center protrusion part 22 are right angles. In the present embodiment, the angles between the center discharge surface 221 of the center protrusion part 22 and the four side surfaces 222 of the center protrusion part 22 are right angles. As illustrated in FIG. 26, the center protrusion part 22 has four angles formed between the adjacent side surfaces 222. The four angles between the side surfaces of the center protrusion part 22 are oriented in the vertical direction Y or the lateral direction X.

Figure 27:
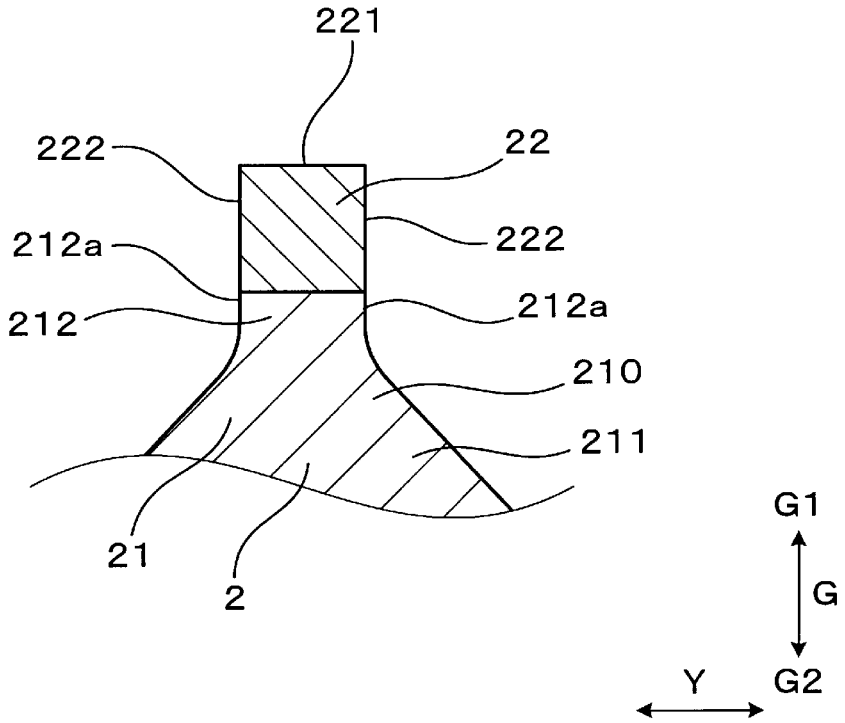
FIG. 27 is an arrow cross-sectional view of FIG. 26 taken along line XXVII-XXVII.

At least one of the angles between the plurality of side surfaces 222 of the center protrusion part 22 is a center specific angle 22*a* located at the end portion of the center protrusion part 22 opposite to the connection part 331 side of the lateral direction X. In the present embodiment, among the angles between the side surfaces 222 of the center protrusion part 22, the angle oriented to the X1 side of the lateral direction X is the center specific angle 22*a*. The surfaces forming the center specific angle 22*a* among the side surfaces 222 of the center protrusion part 22 are flush with the side surfaces of the center base material 21. In the present embodiment, the side surfaces of the base material tip end portion 210 are flush with the side surfaces 222 of the center protrusion part 22. That is, the entire side surfaces of the base material tip end portion 210 are flush with the side surfaces 222 of the center protrusion part 22. Specifically, all the four side surfaces 222 of the center protrusion part 22 are flush in a planar form with the four side surfaces 212*a* of the base material extension portion 212 of the base material tip end portion 210 of the center base material 21. As illustrated in FIG. 27, the four angles formed between the adjacent side surfaces 222 of the center protrusion part 22 are smoothly connected in a linear fashion to the four angles formed between the adjacent side surfaces 212*a* of the base material extension portion 212 of the center base material 21.

Figure 24:
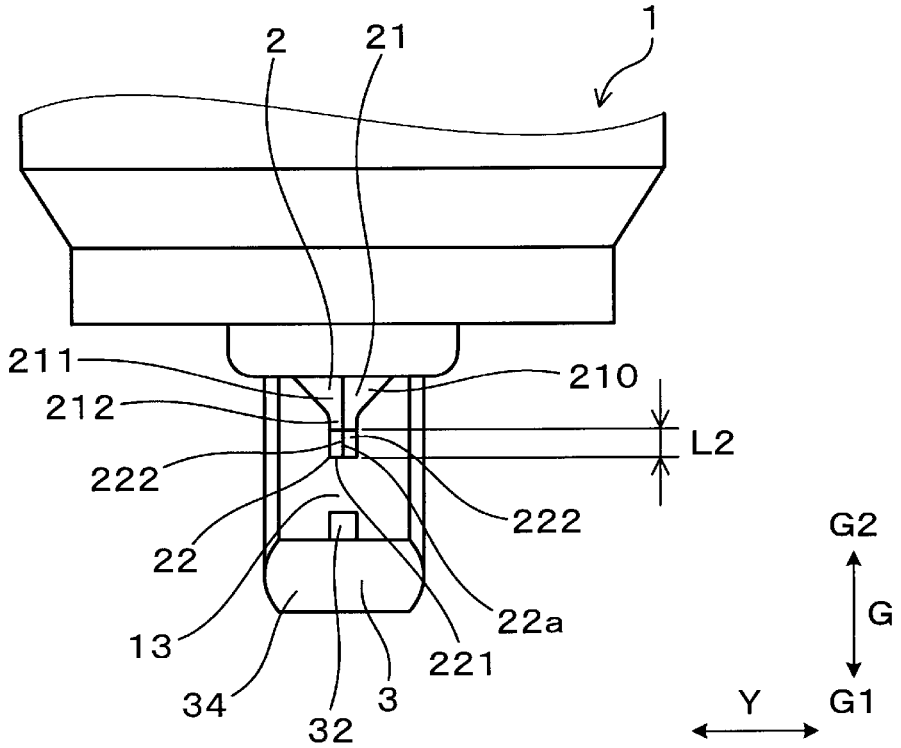
FIG. 24 is a diagram of a tip end portion and its vicinity, in a spark plug in a fifth embodiment as seen from a lateral direction.
Figure 25:
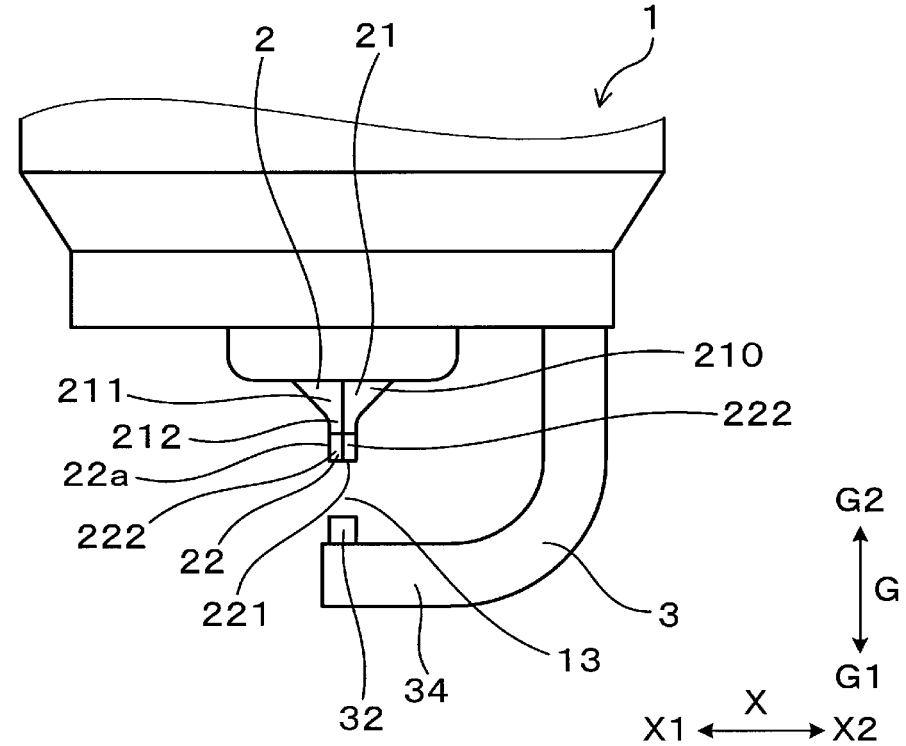
FIG. 25 is a diagram of the tip end portion and its vicinity, in the spark plug in the fifth embodiment as seen from a vertical direction.

As illustrated in FIG. 24, in the gap direction G, the protrusion length L2 of the center protrusion part 22 from the center base material 21 is 0.5 mm or more. That is, the length L2 from the tip end surface of the base material tip end portion 210 in the gap direction G to the center discharge surface 221 of the center protrusion part 22 is 0.5 mm or more. The protrusion length L2 of the center protrusion part 22 from the center base material 21 in the gap direction G is preferably set to 1.0 mm or less from the viewpoint of preventing pre-ignition. Specifically, when the protrusion length L2 becomes larger than 1.0 mm, the ground electrode 3 is formed closer to the G1 side, that is, closer to the center of the combustion chamber at a relatively high temperature. As a result, with the protrusion length L2 of more than 1.0 mm, the ground electrode 3 may come under high temperature conditions, thereby resulting in pre-ignition. Further, when the protrusion length L2 becomes longer than 1.0 mm, the temperature of the ground electrode 3 become higher and the center protrusion part 22 of the center electrode 2 in the vicinity of the ground electrode 3 may be excessively heated. At a high temperature, the center protrusion part 22 forms an oxide film on its surface to protect the center protrusion part 22. However, with an excessive rise in temperature, the center protrusion part 22 may not form an oxide film on the center protrusion part 22. Therefore, the protrusion length L2 is preferably set to 1.0 mm or less from the viewpoint of ensuring oxidation-resistance of the center protrusion part 22.

In the present embodiment, the shape of the ground electrode 3 is similar to that in the comparative embodiment. That is, the inward-facing part 34 of the ground electrode 3 is uniformly formed such that its width in the vertical direction is constant in the lateral direction X. In addition, the columnar ground protrusion part 32 protrudes from the G2-side surface of the inward-facing part 34 to the G2 side. As seen in the gap direction G, the outer shape of the ground protrusion part 32 is within the outer shape of the inward-facing part 34.

In other respects, the fifth embodiment is similar to the first embodiment.

In the present embodiment, the protrusion length of the center protrusion part 22 from the center base material 21 is 0.5 mm or more in the gap direction G. This suppresses an increase in the distance between both starting points of the discharge spark in the gap direction G, and suppresses occurrence of blow-off and re-discharge of the discharge spark S. This numerical value will be supported by experimental examples described later.

The angles between the center discharge surface 221 and the side surfaces 222 of the center protrusion part 22 are right angles or acute angles. This makes it easy to keep the center electrode-side starting point of the discharge spark at the angles between the center discharge surface 221 and the side surfaces 222 of the center protrusion part 22, thereby suppressing the blow-off and re-discharge of the discharge spark.

At least one of the angles between the plurality of side surfaces 222 of the center protrusion part 22 is the center specific angle 22*a* that is located at the end portion of the center protrusion part 22 opposite to the connection part 331 side of the lateral direction X. This makes it possible to form a portion of the center protrusion part 22 around which an electric field tends to concentrate, at the end portion on the X1 side of the lateral direction X. This makes it easy to keep the center electrode-side starting point of the discharge spark at the end portion on the X1 side of the lateral direction X among the angles between the center discharge surface 221 and the side surfaces 222 of the center protrusion part 22. The surfaces forming the center specific angle 22*a* among the side surfaces 222 of the center protrusion part 22 are flush with the side surfaces of the center base material 21. This suppresses the concentration of an electric field around the center specific angle 22*a* and the portion of the center base material 21 in the vicinity of the surfaces forming the center specific angle 22*a*. This suppresses the movement of the center electrode-side starting point of the discharge spark from the center protrusion part 22 to the center base material 21. This also suppresses the blow-off and re-discharge of the discharge spark.

The side surfaces of the base material tip end portion 210 are flush with the side surfaces 222 of the center protrusion part 22. This makes it possible to prevent the formation of portions around which an electric field tends to concentrate between the side surfaces of the base material tip end portion 210 and the side surfaces 222 of the center protrusion part 22. Therefore, the center electrode-side starting point of the discharge spark is even easier to keep on the center discharge surface 221.

The center protrusion part 22 has a square cross section orthogonal to the gap direction G. This makes it easy to provide the center protrusion part 22 with angles around which an electric field tends to concentrate. This makes it easy to suppress movement of the center electrode-side starting point of the discharge spark from the center protrusion part 22 to the center base material 21.

As described above, according to the present embodiment, it is possible to provide a spark plug for internal combustion engine that is less prone to cause re-discharge.

Figure 29:
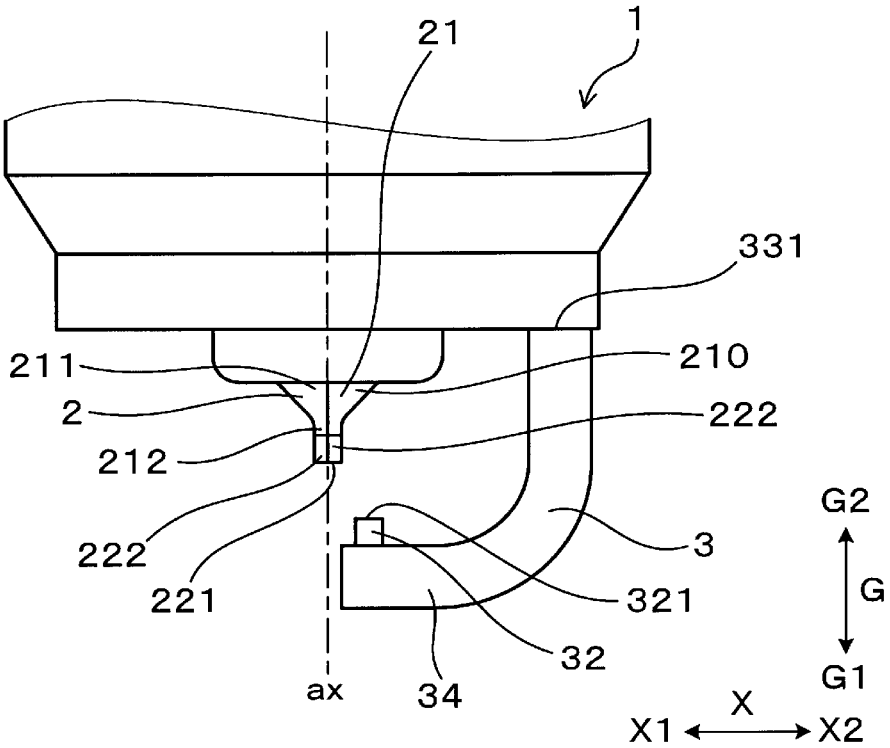
FIG. 29 is a diagram of a tip end portion and its vicinity, in a spark plug in a modified embodiment of the fifth embodiment as seen from a vertical direction.

As illustrated in FIG. 29, a spark plug identical in basic structure to the present embodiment may be configured such that the end edge of the ground electrode 3 opposite to the connection part 331 side of the lateral direction X is located closer to the connection part 331 side of the lateral direction X than the axis ax of the center electrode 2 as in the fourth embodiment. This makes it easy to suppress the ground electrode-side starting point of the discharge spark from the ground discharge surface 321 of the ground protrusion part 32 from moving further towards the X2 side than the ground discharge surface 321 of the inward-facing part 34.

Second Experimental Example

Figure 30:
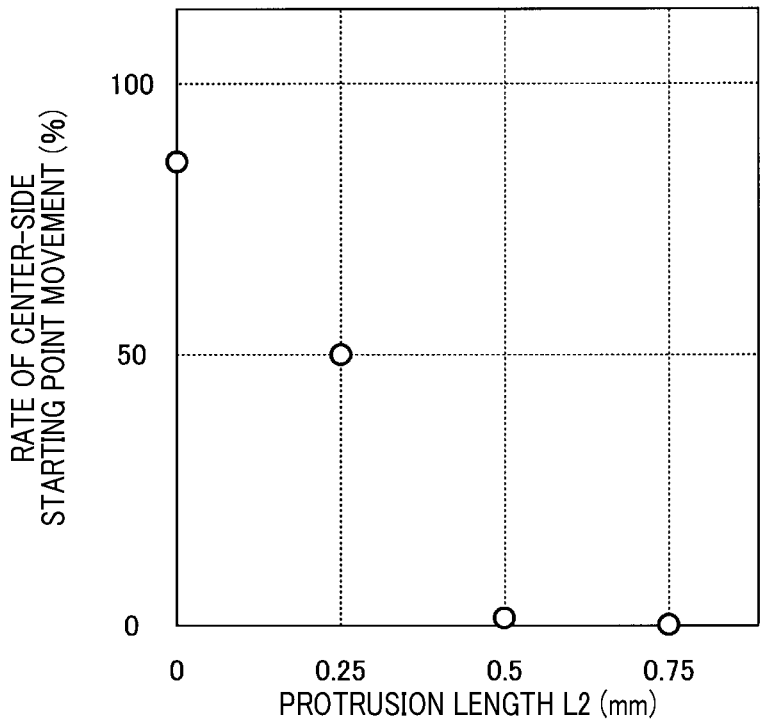
FIG. 30 is a diagram illustrating a relationship between a protrusion length L2 and a center starting point movement ratio in a second experimental example.

The present example is an example of a spark plug similar in basic structure to the fifth embodiment in which the relationship between the protrusion length L2 and the rate of center starting point movement is evaluated as illustrated in FIG. 30. The rate of center starting point movement is the rate of movement of the center electrode-side starting point of the discharge spark from the center protrusion part 22 to the center base material 21, which was obtained by observing discharge that was caused 20 times between the center electrode and the ground electrode.

In the present example, four samples were prepared, which were similar in basic structure to the spark plug 1 in the fifth embodiment and had protrusion lengths L2 of 0 mm, 0.25 mm, 0.5 mm, and 0.75 mm.

Each of the samples was measured to determine the rate of center starting point movement. FIG. 30 shows the results. The test conditions are the same as those in the first experimental example.

As seen from FIG. 30, when the protrusion length L2 is 0.5 mm or more, the rate of center starting point movement becomes as small a value as approximately 0%. On the other hand, when the protrusion length L2 is 0.25 mm or less, the rate of center starting point movement rises sharply as compared to the case in which the protrusion length L2 is 0.5 mm or more. That is, from the viewpoint of reducing the of ground-side starting point movement, the protrusion length L2 of the center protrusion part 22 from the center base material 21 in the gap direction G is preferably 0.5 mm or more.

Figure 31:
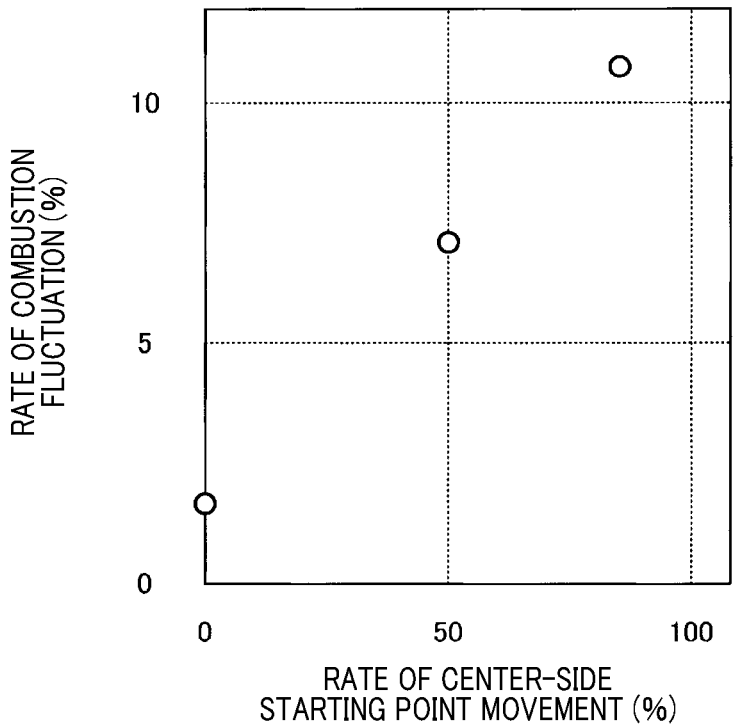
FIG. 31 is a diagram illustrating the rate of center starting point movement and the rate of combustion fluctuation in the second experimental example.

Next, as illustrated in FIG. 31, the relationship between the rate of center starting point movement and the rate of combustion fluctuation was examined. The test conditions are the same as those in the first experimental example.

As can be seen from FIG. 31, the lower the rate of center starting point movement, the lower the rate of combustion change rate becomes. That is, the lower the rate of center starting point movement, the better the ignitability becomes.

As above, it can be seen from FIG. 31 that, as the lower the rate of center starting point movement, the more the ignitability becomes improved, and it can be seen from FIG. 30 that, from the viewpoint of reducing the rate of center starting point movement, the protrusion length L2 of the center protrusion part 22 from the center base material 21 is preferably 0.5 mm or more in the gap direction G. That is, from the viewpoint of improving the ignitability, the protrusion length L2 of the center protrusion part 22 from the center base material 21 is preferably 0.5 mm or more in the gap direction G.

Sixth Embodiment

Figure 32:
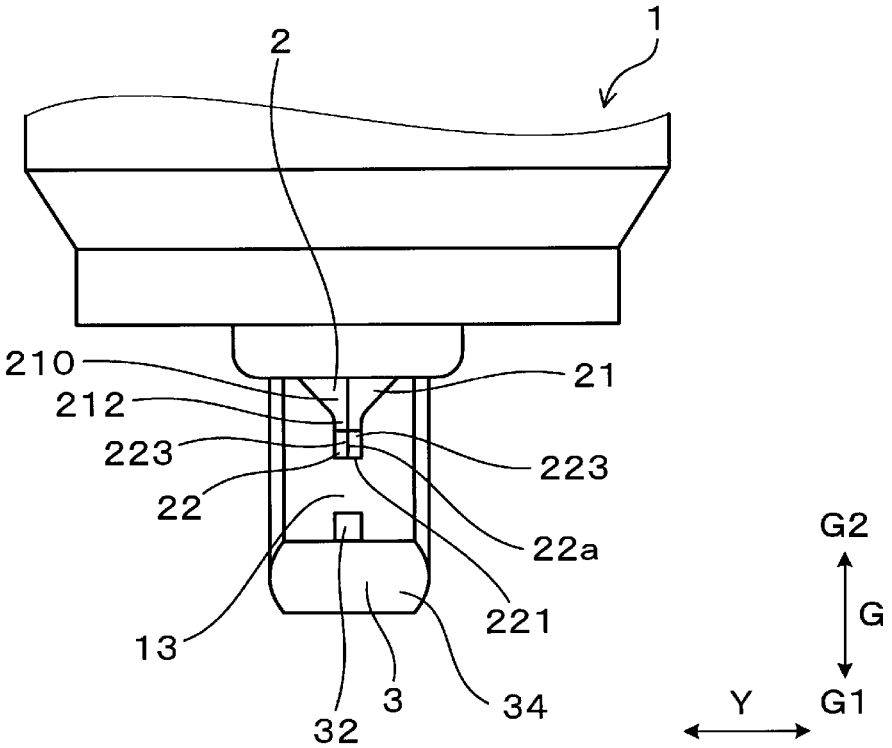
FIG. 32 is a diagram of a tip end portion and its vicinity, in a spark plug in a sixth embodiment as seen from a lateral direction.
Figure 33:
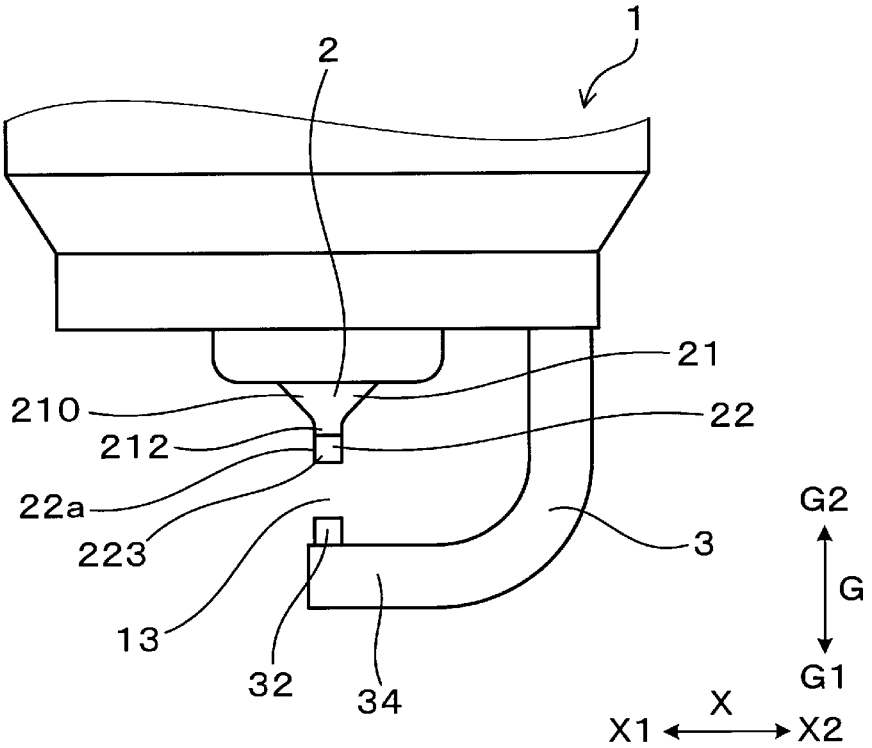
FIG. 33 is a diagram of the tip end portion and its vicinity, in the spark plug in the sixth embodiment as seen from a vertical direction.
Figure 34:
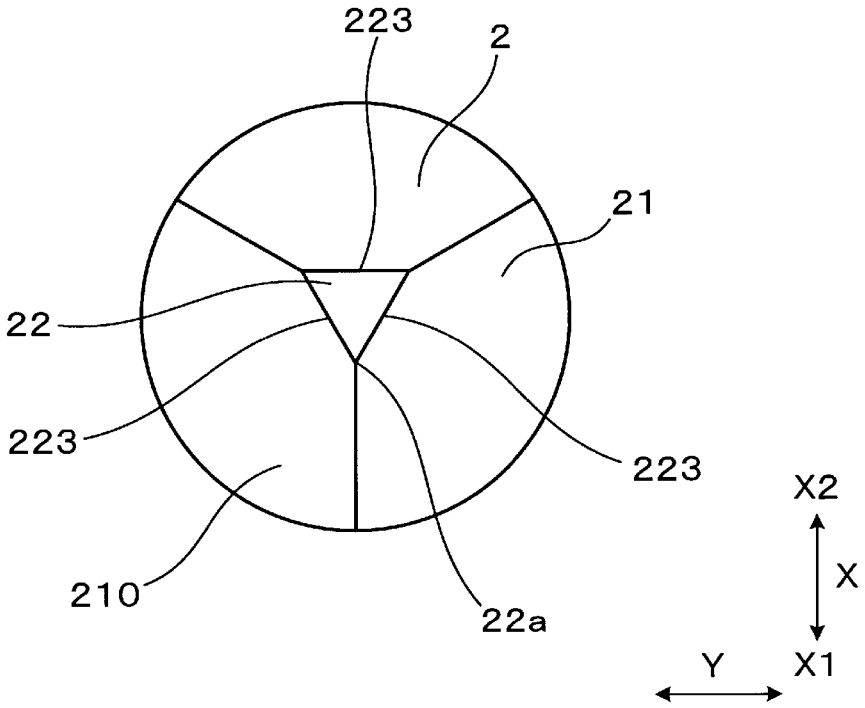
FIG. 34 is a diagram of a tip end portion of a center electrode in the sixth embodiment as seen from a ground electrode side in a gap direction.

The present embodiment is an embodiment obtained by modifying the shape of the center electrode 2 in the fifth embodiment as illustrated in FIGS. 32 to 34. In the present embodiment, the center protrusion part 22 has the shape of a triangular column. As illustrated in FIG. 34, the cross section of the center protrusion part 22 orthogonal to the gap direction G has a triangular shape. Specifically, the cross section of the center protrusion part 22 orthogonal to the gap direction G has a triangular shape that is narrower toward the X1 side.

The center protrusion part 22 has three side surfaces 223. The center protrusion part 22 has three angles formed between the adjacent side surfaces 223. One of the three angles is the center specific angle 22*a* located at the X1-side end portion of the center protrusion part 22. The center specific angle 22*a* is oriented to the X1 side of the lateral direction X.

The cross section of the base material extension portion 212 of the base material tip end portion 210 of the center base material 21 orthogonal to the gap direction G has a triangular shape. The cross section of the base material extension portion 212 orthogonal to the gap direction G is the same in shape as the cross section of the center protrusion part 22 orthogonal to the gap direction G.

In other respects, the sixth embodiment is similar to the fifth embodiment.

In the present embodiment, the center protrusion part 22 has a triangular cross section orthogonal to the gap direction G. This makes it easy to provide the ground protrusion part 32 with angles around which an electric field tends to concentrate. This makes it easy to suppress the movement of the center electrode-side starting point of the discharge spark from the center protrusion part 22 to the center base material 21.

In other respects, the sixth embodiment exhibits actions and effects similar to those of the fifth embodiment.

Seventh Embodiment

Figure 38:
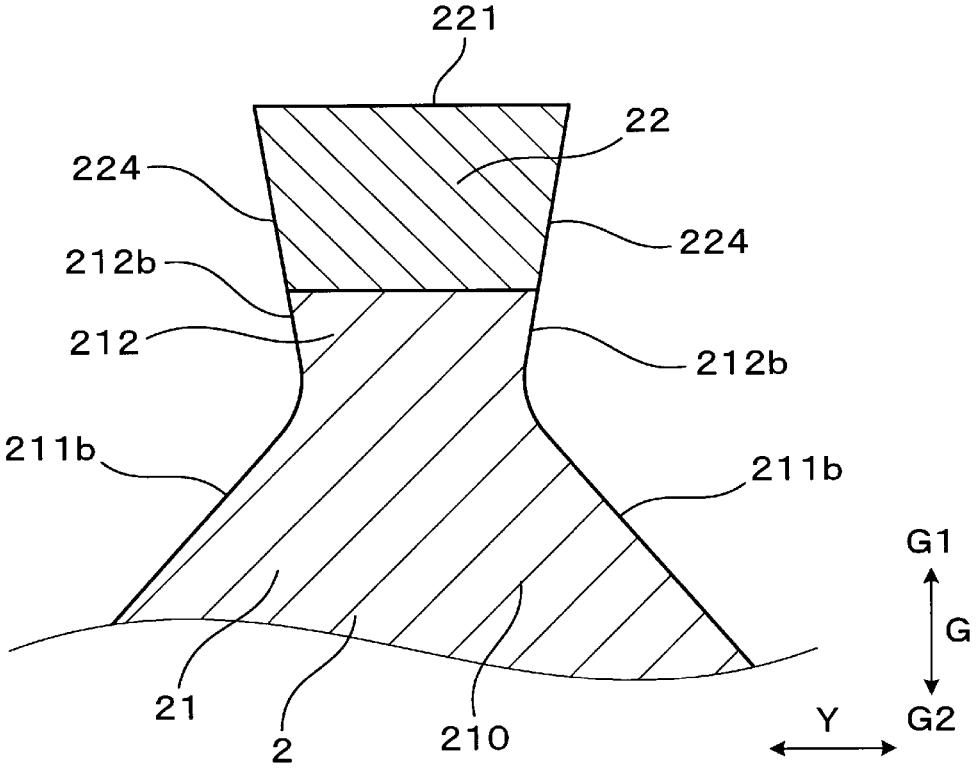
FIG. 38 is an arrow cross-sectional view of FIG. 37 taken along line XXXVIII-XXXVIII.
Figure 39:
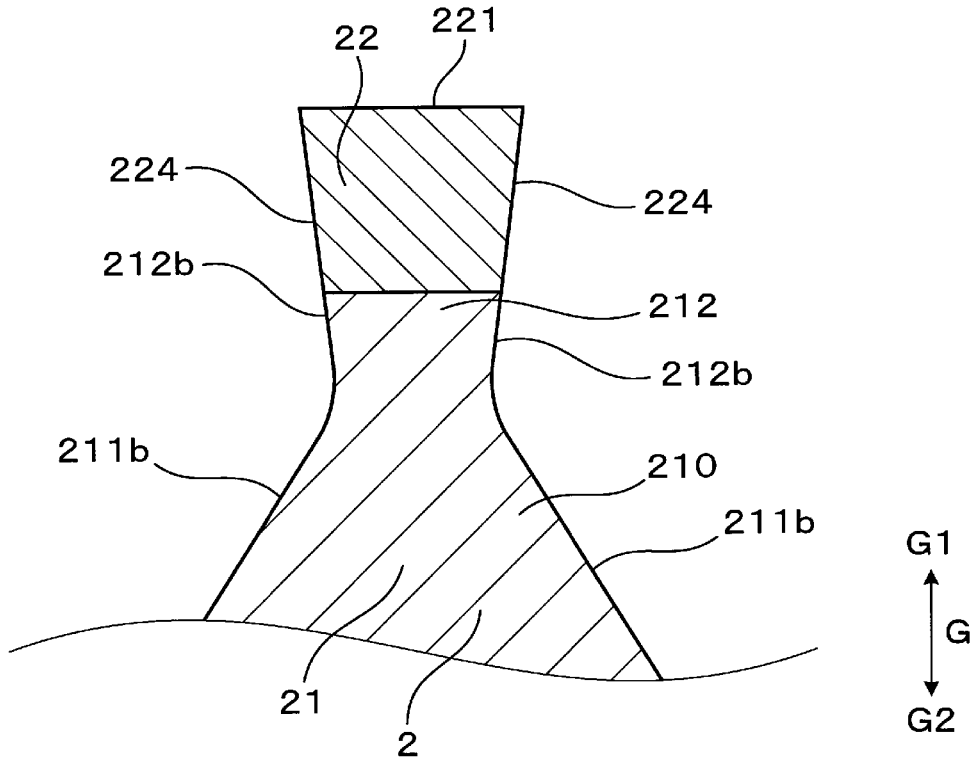
FIG. 39 is an arrow cross-sectional view of FIG. 37 taken along line XXXIX-XXXIX.

The present embodiment is an embodiment obtained by modifying the shape of the center electrode 2 in the fifth embodiment as illustrated in FIGS. 35 to 39. As illustrated in FIGS. 38 and 39, in the present embodiment, the center protrusion part 22 reduces in diameter toward the G2 side. The angle between the center discharge surface 221 and at least one side surface 224 of the center protrusion part 22 is an acute angle.

In the present embodiment, the cross section of the center protrusion part 22 orthogonal to the gap direction G has a square shape. The four side surfaces 224 of the center protrusion part 22 are inclined towards the inner peripheral side of the center protrusion part 22 toward the G2 side. That is, in the present embodiment, the angles between the center discharge surface 221 and all the side surfaces 224 of the center protrusion part 22 are acute angles.

Figure 35:
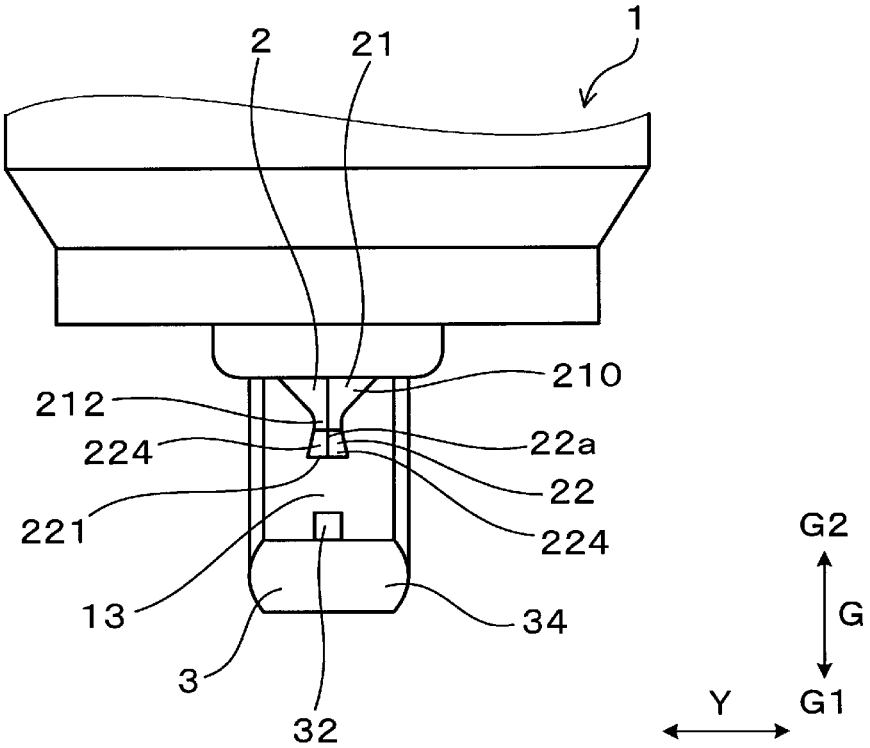
FIG. 35 is a diagram of a tip end portion and its vicinity, in a spark plug in a seventh embodiment as seen from a lateral direction.
Figure 36:
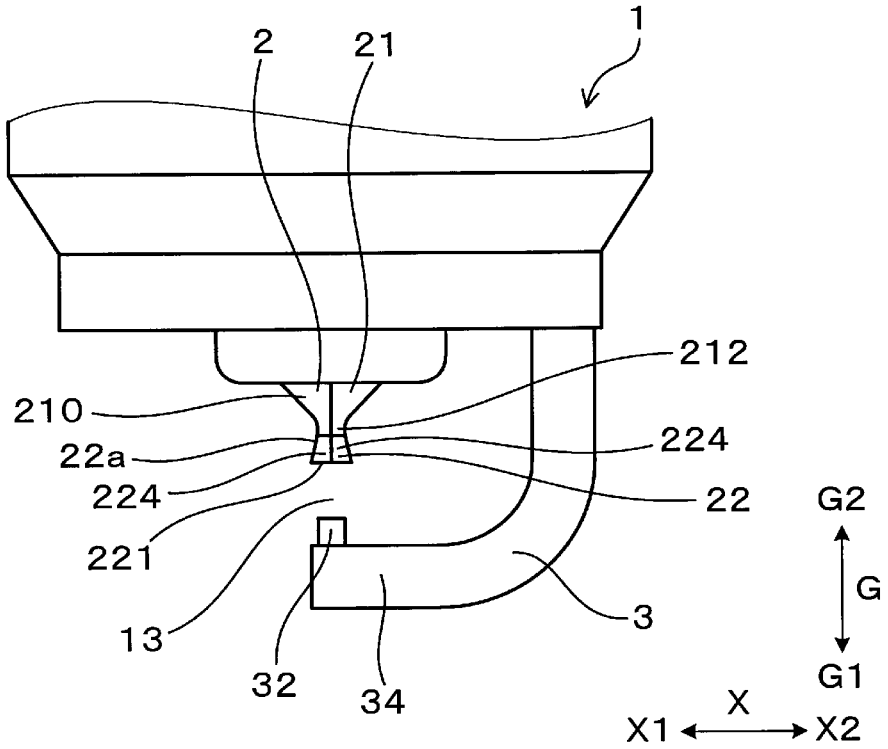
FIG. 36 is a diagram of the tip end portion and its vicinity, in the spark plug in the seventh embodiment as seen from a vertical direction.
Figure 37:
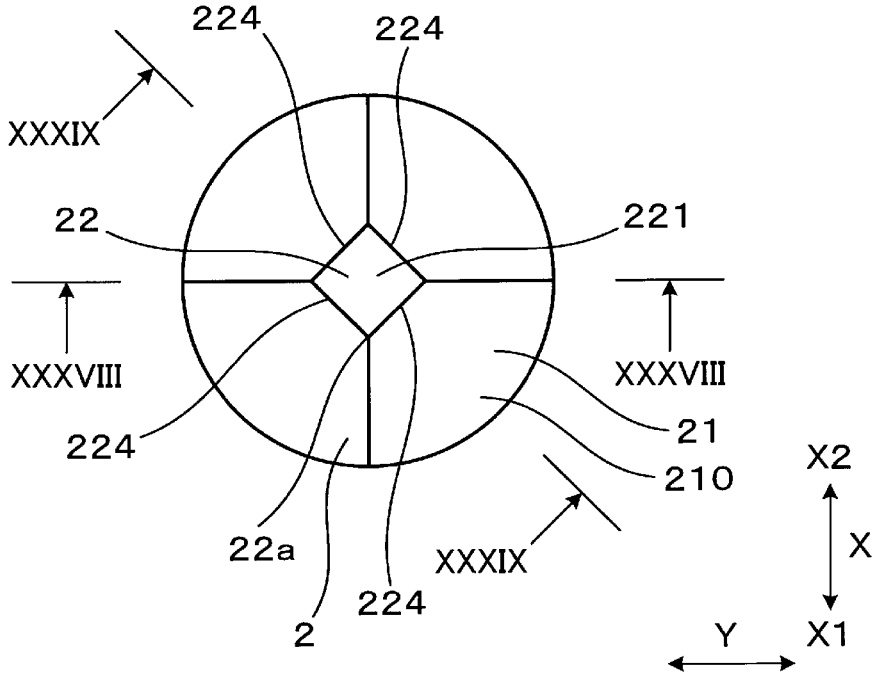
FIG. 37 is a diagram of a tip end portion of a center electrode in the seventh embodiment as seen from a ground electrode side in a gap direction.

As illustrated in FIGS. 35 and 36, the base material extension portion 212 of the base material tip end portion 210 of the center base material 21 reduces in diameter toward the G2 side. As illustrated in FIGS. 38 and 39, four side surfaces 212*b* of the base material extension portion 212 are inclined toward the inner peripheral side of the base material extension portion 212 toward the G2 side. In the present embodiment, the four side surfaces 212*b* of the base material extension portion 212 are flush with the four side surfaces 224 of the center protrusion part 22. The four side surfaces 212*b* of the base material extension portion 212 of the base material tip end portion 210 are flush with side surfaces 211*b* of the base material diameter-reduced portion 211 of the base material tip end portion 210.

In other respects, the seventh embodiment is similar to the fifth embodiment.

In the present embodiment, the angles between the center discharge surface 221 and the side surfaces 224 of the center protrusion part 22 are acute angles. This makes it easy to ensure the intensity of an electric field around the angles between the center discharge surface 221 and the side surfaces 224 of the center protrusion part 22. This makes it easy to keep the center electrode-side starting point of the discharge spark at the angles between the center discharge surface 221 and the side surfaces 224 of the center protrusion part 22.

In other respects, the seventh embodiment exhibits actions and effects similar to those of the fifth embodiment.

Eighth Embodiment

Figure 40:
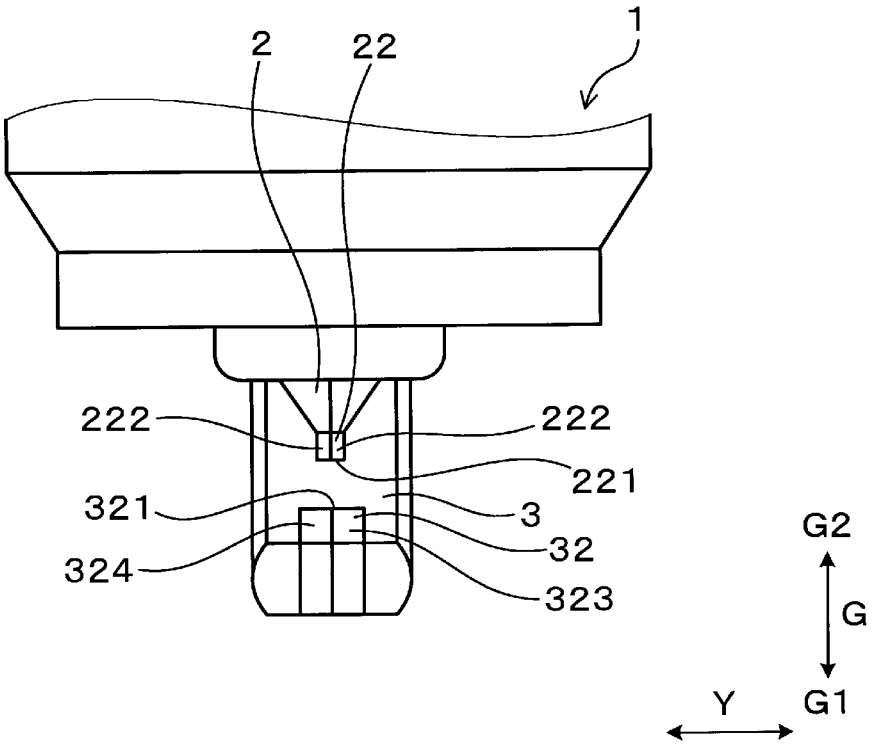
FIG. 40 is a diagram of a tip end portion and its vicinity, in a spark plug in an eighth embodiment as seen from a lateral direction.
Figure 41:
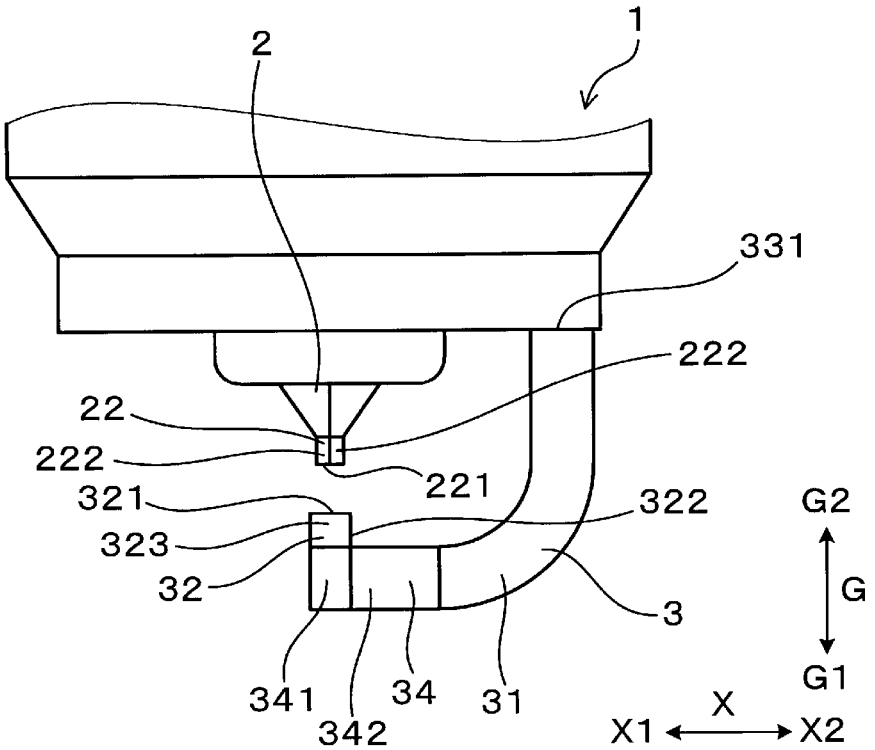
FIG. 41 is a diagram of the tip end portion and its vicinity, in the spark plug in the eighth embodiment as seen from a vertical direction.

The present embodiment is similar in the shape of the ground electrode 3 to the first embodiment, and is similar in the shape of the center electrode 2 to the fifth embodiment, as illustrated in FIGS. 40 and 41. In other respects, the eighth embodiment is similar in basic structure to the first embodiment.

In the present embodiment, it is possible to obtain the actions and effects of the first embodiment and the actions and effects of the fifth embodiment. In the present embodiment, it is further possible to concentrate an electric field around both the angles between the ground discharge surface 321 and the side surfaces 322, 323, and 324 of the ground protrusion part 32 and the angles between the center discharge surface 221 and the side surfaces 222 of the center protrusion part 22. Accordingly, both starting points of the discharge spark can be further easily kept at the angles between the ground discharge surface 321 and the side surfaces 322 of the ground protrusion part 32 and at the angles between the center discharge surface 221 and the side surfaces 222 of the center protrusion part 22.

The present disclosure has been described so far according to the embodiments, but it is noted that the present disclosure is not limited to the foregoing embodiments or structures. The present disclosure includes various modifications and changes in a range of equivalency. In addition, various combinations and modes, and other combinations and modes including only one element of the foregoing combinations and modes, less or more than the one element are included in the scope and conceptual range of the present disclosure.

Figure 42:
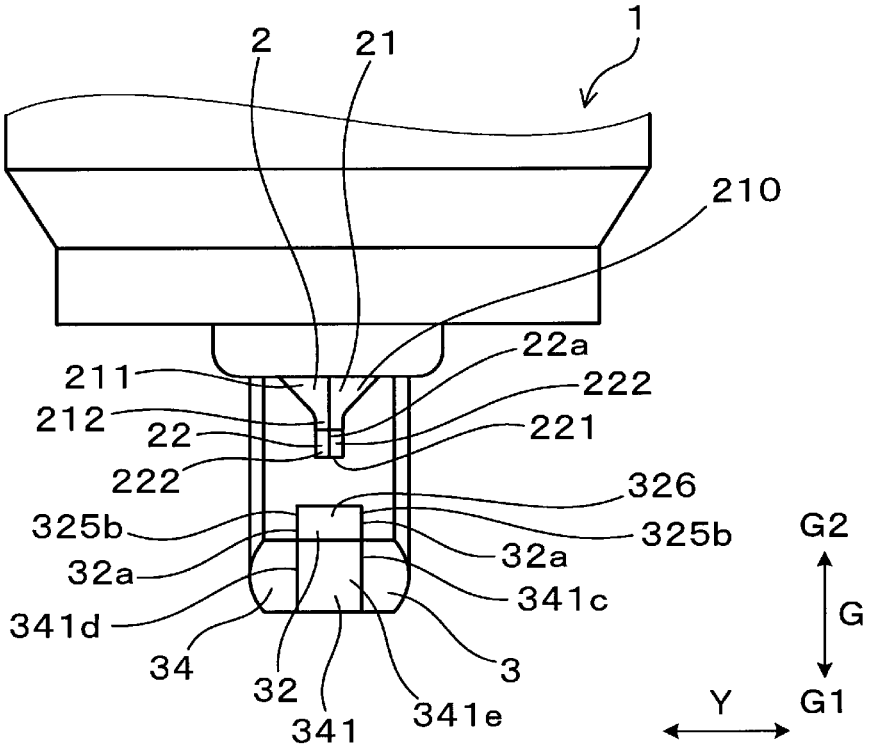
FIG. 42 is a diagram of a tip end portion and its vicinity, in a spark plug as seen from a lateral direction in a modification embodiment in which the second embodiment and the fifth embodiment are combined.

For example, as illustrated in FIG. 42, it is possible to employ a mode in which the ground electrode 3 is similar in shape to that in the second embodiment and the center electrode 2 is similar in shape to that in the fifth embodiment.

Figure 43:
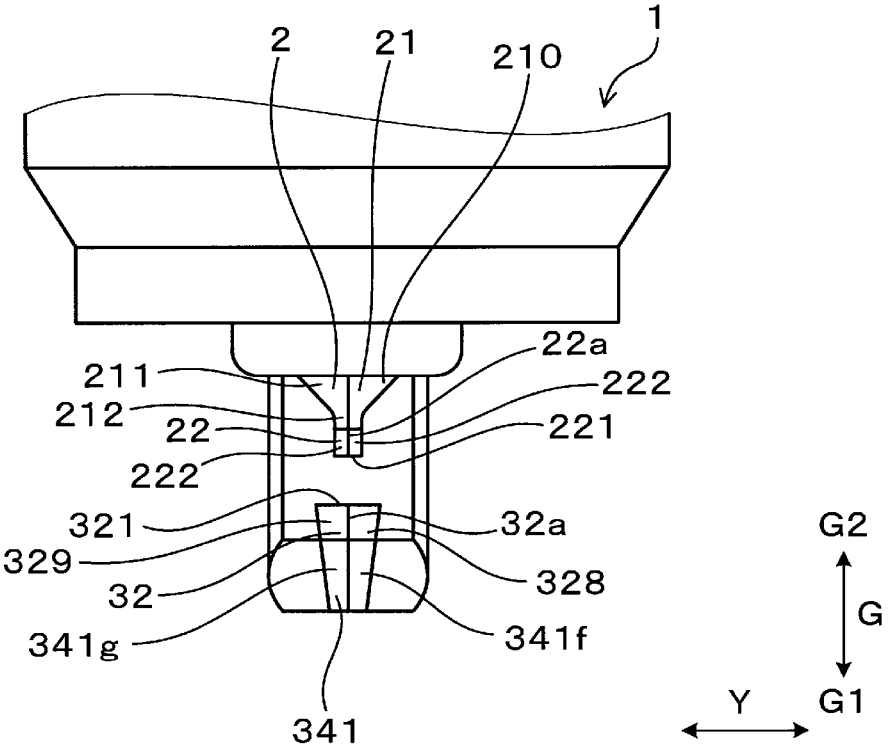
FIG. 43 is a diagram of a tip end portion and its vicinity, in a spark plug as seen from a lateral direction in a modification embodiment in which the third embodiment and the fifth embodiment are combined.

As illustrated in FIG. 43, it is possible to employ a mode in which the ground electrode is similar in shape to that in the third embodiment and the center electrode is similar in shape to that in the fifth embodiment.

In the first embodiment and others, the gap direction G is the axial direction, and thus the orthogonal direction described above (that is, the direction orthogonal to the gap direction G among the planar directions parallel to both the lateral direction X and the axial direction) is the lateral direction X. However, when the gap direction G is inclined with respect to the axial direction, the orthogonal direction is a direction inclined with respect to the lateral direction X.

What is claimed is:

1. A spark plug for internal combustion engine comprising:

a cylindrical housing;

cylindrical insulating glass held in the housing;

a center electrode that is held in the insulating glass, a tip end portion of the center electrode protruding; and a ground electrode that has a connection part connected to the housing and forms a spark discharge gap between the center electrode and the ground electrode, wherein the ground electrode has a ground base material that includes the connection part and a ground protrusion part that protrudes from the ground base material toward the center electrode and forms the spark discharge gap between the center electrode and the ground electrode, an angle between a ground discharge surface of the ground protrusion part facing the spark discharge gap and a side surface of the ground protrusion part is a right angle or an acute angle, at least a portion of the side surface of the ground protrusion part and at least a portion of a side surface of the ground base material are flush with each other the ground protrusion part has a plurality of the side surfaces, when, of planar directions parallel to both an axial direction and a lateral direction which is orthogonal to the axial direction and in which the connection part of the ground electrode and the center electrode are aligned, a direction orthogonal to the gap direction in which the center electrode, the spark discharge gap, and the ground electrode are aligned is defined as an orthogonal direction, at least one of angles between the plurality of side surfaces of the ground protrusion part is a ground specific angle that is located at an end portion of the ground protrusion part opposite to the connection part side of the orthogonal direction, surfaces forming the ground specific angle among the side surfaces of the ground protrusion part are flush with the side surface of the ground base material, and a cross section of the ground protrusion part orthogonal to the gap direction in which the center electrode, the spark discharge gap, and the ground electrode are aligned has a triangular shape.

2. The spark plug for internal combustion engine according to claim 1, wherein, in a gap direction in which the center electrode, the spark discharge gap, and the ground electrode are aligned, a protrusion length L1 of the ground protrusion part from the ground base material is 0.5 mm or more.

3. The spark plug for internal combustion engine according to claim 1, wherein the angle between the ground discharge surface and at least one side surface of the ground protrusion part is an acute angle.

4. The spark plug for internal combustion engine according to claim 1, wherein, in the lateral direction that is orthogonal to the axial direction and in which the connection part of the ground electrode and the center electrode are aligned, an end edge of the ground electrode opposite to the connection part side is located closer to the connection part side of the lateral direction than an axis of the center electrode is.

5. The spark plug for internal combustion engine according to claim 1 wherein a side surface of a ground base material end portion as a longitudinal end portion of the ground base material opposite to the connection part is flush with the side surface of the ground protrusion part.

6. A spark plug for internal combustion engine comprising:

a cylindrical housing;

cylindrical insulating glass held in the housing;

a center electrode that is held in the insulating glass, a tip end portion of the center electrode protruding; and a ground electrode that has a connection part connected to the housing and forms a spark discharge gap between the center electrode and the ground electrode, wherein the center electrode has a center base material and a center protrusion part that protrudes from the center base material toward the ground electrode and forms the spark discharge gap between the ground electrode and the center electrode, an angle between a center discharge surface of the center protrusion part opposed to the spark discharge gap and a side surface of the center protrusion part is a right angle or an acute angle, the center protrusion part has a plurality of the side surfaces, when, of planar directions parallel to both an axial direction and a lateral direction which is orthogonal to the axial direction and in which the connection part of the ground electrode and the center electrode are aligned, a direction orthogonal to a gap direction in which the center electrode, the spark discharge gap, and the ground electrode are aligned is defined as an orthogonal direction, at least one of angles between the plurality of side surfaces of the center protrusion part is a center specific angle that is located at an end portion of the center protrusion part opposite to the connection part side of the orthogonal direction, and surfaces forming the center specific angle between the side surfaces of the center protrusion part are flush with a side surface of the center base material.

7. The spark plug for internal combustion engine according to claim 6, wherein, in the gap direction, a protrusion length L2 of the center protrusion part from the center base material is 0.5 mm or more.

8. The spark plug for internal combustion engine according to claim 6, wherein an angle between the center discharge surface and at least one of the side surfaces of the center protrusion part is an acute angle.

9. The spark plug for internal combustion engine according to claim 6, wherein, in the lateral direction, an end edge of the ground electrode opposite to the connection part is located closer to the connection part side of the lateral direction than an axis of the center electrode is.

10. The spark plug for internal combustion engine according to any claim 6, wherein a side surface of a base material tip end portion as a tip end portion of the center base material is flush with the side surfaces of the center protrusion part.

11. The spark plug for internal combustion engine according to claim 6, wherein a cross section of the center protrusion part orthogonal to the gap direction has a triangular shape or a square shape.

12. The spark plug for internal combustion engine according to claim 6, wherein the ground electrode has a ground base material including the connection part and a ground protrusion part that protrudes from the ground base material toward the center electrode, an angle between a ground discharge surface of the ground protrusion part facing the spark discharge gap and the side surface of the ground protrusion part is a right angle or an acute angle, and at least a portion of the side surface of the ground protrusion part and at least a portion of the side surface of the ground base material are flush with each other.

13. The spark plug for internal combustion engine according to claim 12, wherein, in the gap direction, a protrusion length L1 of the ground protrusion part from the ground base material is 0.5 mm or more.

14. The spark plug for internal combustion engine according to claim 12, wherein an angle between the ground discharge surface and at least one side surface of the ground protrusion part is an acute angle.

15. The spark plug for internal combustion engine according to claim 12, wherein the ground protrusion part has a plurality of the side surfaces, at least one of angles between the plurality of side surfaces of the ground protrusion part is a ground specific angle that is located at an end portion of the ground protrusion part opposite to the connection part side of the orthogonal direction, and surfaces forming the ground specific angle among the side surfaces of the ground protrusion part are flush with the side surface of the ground base material.

16. The spark plug for internal combustion engine according to claim 12, wherein a side surface of a ground base material end portion as a longitudinal end portion of the ground base material opposite to the connection part is flush with the side surface of the ground protrusion part.

17. The spark plug for internal combustion engine according to claim 12, wherein a cross section of the ground protrusion part orthogonal to the gap direction has a triangular shape or a square shape.

* * * * *